US012339098B2

(12) United States Patent
Sheets, Jr.

(10) Patent No.: US 12,339,098 B2
(45) Date of Patent: Jun. 24, 2025

(54) ENCLOSED REFLEX SIGHT FOR FIREARMS, ASSEMBLY, SYSTEM AND METHOD

(71) Applicant: PRIMARY ARMS, LLC, Houston, TX (US)

(72) Inventor: Robert E. Sheets, Jr., Houston, TX (US)

(73) Assignee: PRIMARY ARMS, LLC, Houston, TX (US)

( * ) Notice: Subject to any disclaimer, the term of this patent is extended or adjusted under 35 U.S.C. 154(b) by 15 days.

(21) Appl. No.: 18/372,472

(22) Filed: Sep. 25, 2023

(65) Prior Publication Data

US 2024/0110765 A1 Apr. 4, 2024

Related U.S. Application Data

(60) Provisional application No. 63/412,351, filed on Sep. 30, 2022.

(51) Int. Cl.
*F41G 1/30* (2006.01)
*F41G 11/00* (2006.01)

(52) U.S. Cl.
CPC ..... *F41G 1/30* (2013.01); *F41G 11/001* (2013.01)

(58) Field of Classification Search
None
See application file for complete search history.

(56) References Cited

U.S. PATENT DOCUMENTS 3,915,552 A * 10/1975 Rickert ..... F41G 1/345 356/252
5,033,219 A * 7/1991 Johnson ..... F41G 1/35 42/126

(Continued)

FOREIGN PATENT DOCUMENTS

WO WO-2019068165 A1 * 4/2019 ..... F41G 1/30

OTHER PUBLICATIONS

PCT Notification of Transmittal of the International Search Report and the Written Opinion of the International Searching Authority, or the Declaration; Jan. 19, 2024; International Application No. PCT/US2023/033636; International Searching Authority, United States Patent and Trademark Office.

(Continued)

*Primary Examiner* — Derrick R Morgan
(74) *Attorney, Agent, or Firm* — The Compton Law Firm, P.C.; Scott D. Compton

(57) ABSTRACT

The disclosure is related to an enclosed reflex sight for one or more firearms. The enclosed reflex sight may be provided as part of an assembly including a mounting interface. The enclosed reflex sight includes a rearward bottom portion that houses an adjustment assembly, wherein the rearward bottom portion includes a lowermost surface of the enclosed reflex sight. The enclosed reflex sight includes an upper bottom surface forward of the rearward bottom portion of the enclosed reflex sight, the upper bottom surface comprising an abutment surface for the mounting interface. When the assembly is secured to an upper mounting surface of a firearm then the lowermost surface of the rearward bottom portion of the enclosed reflex sight is closer to the upper mounting surface of the firearm than the upper bottom surface of the enclosed reflex sight.

4 Claims, 23 Drawing Sheets

(56) References Cited

U.S. PATENT DOCUMENTS 5,369,888 A * 12/1994 Kay ..... F41G 1/30 356/252
5,625,954 A * 5/1997 DePaoli ..... F41G 1/345 42/126
5,653,034 A * 8/1997 Bindon ..... G02B 23/105 33/297
5,815,936 A * 10/1998 Sieczka ..... G03H 1/0005 42/114
6,490,060 B1 12/2002 Tai et al.
7,145,703 B2 12/2006 Sieczka et al.
10,139,197 B1 * 11/2018 Horton ..... F41G 1/383
10,234,238 B1 * 3/2019 Thomas ..... F41G 3/08
11,549,768 B1 * 1/2023 Pischke ..... F41G 1/06
12,188,747 B2 * 1/2025 Boudreau ..... F41G 1/065
2003/0131518 A1 * 7/2003 Komberger ..... F41G 11/007 42/135
2010/0077646 A1 * 4/2010 Gaber ..... F41G 1/467 42/129
2011/0290968 A1 * 12/2011 Maughan ..... F41G 11/004 248/231.51
2011/0297744 A1 * 12/2011 Schneider ..... F41G 1/467 235/414
2014/0237884 A1 8/2014 Koesler et al.
2015/0198421 A1 * 7/2015 Crispin ..... F41G 11/006 42/126
2015/0267997 A1 * 9/2015 Collin ..... G02B 23/2446 359/1
2016/0021329 A1 * 1/2016 Sakiewicz ..... F41G 1/35 386/227
2016/0033232 A1 * 2/2016 Cheng ..... F41G 1/345 42/114
2016/0327366 A1 11/2016 Campean
2018/0195835 A1 * 7/2018 Crispin ..... F41G 1/30
2018/0219349 A1 * 8/2018 Lemire ..... F41J 5/00
2020/0081342 A1 * 3/2020 Baker ..... F41G 1/54
2020/0200507 A1 * 6/2020 Curry ..... F41G 1/30
2020/0232759 A1 7/2020 York et al.
2021/0157267 A1 * 5/2021 Heath ..... F41G 1/30
2021/0172704 A1 6/2021 Nackel et al.
2021/0270572 A1 9/2021 Dawson, Jr.
2022/0034629 A1 2/2022 Hamilton
2022/0325981 A1 * 10/2022 Lee ..... F41G 1/30
2023/0185074 A1 * 6/2023 Crispin ..... F41G 1/345 359/428
2023/0314100 A1 * 10/2023 Niswander ..... F41G 1/30 42/111
2023/0341213 A1 * 10/2023 Lee ..... F41G 11/003

OTHER PUBLICATIONS

Sheets, Jr., Claims 1-26 of International Application No. PCT/US2023/033636; Sep. 25, 2023.

* cited by examiner

ENCLOSED REFLEX SIGHT FOR FIREARMS, ASSEMBLY, SYSTEM AND METHOD

CROSS-REFERENCE TO RELATED APPLICATIONS

This application claims benefit of U.S. Provisional Patent Application Ser. No. 63/412,351, filed on Sep. 30, 2022, the content of which is hereby incorporated by reference in its entirety.

BACKGROUND OF THE DISCLOSURE

1. Field of the Disclosure

This disclosure relates generally in the field of optical sights for firearms.

2. Background Art

A reflex sight is a type of non-magnified (lx) electronic optical sight for firearms that is commercially available as an open reflex sight and as an enclosed reflex sight. An open reflex sight typically has a partly open housing with a single lens in an optical pathway of a user's eye, e.g., a shooter's eye, and an exposed light source on the housing. An enclosed reflex sight has a housing with multiple lenses in an optical pathway of a user's eye, and a light source located within the housing that assists in protecting the light source against environmental influences such as dirt and moisture.

As understood by the skilled artisan, a housing of an enclosed reflex sight provides a field of view including a projected reticle to assist in aiming a corresponding firearm. Some enclosed reflex sights include windage and elevation adjustment mechanisms within the housing below the field of view. Other enclosed reflex sights house a light source in a pivot tube that allows the windage and elevation adjustment mechanisms to be located at the top of the housing or on the side in line with the field of view. In both configurations, the windage and elevation adjustment mechanisms are operationally configured to assist a user in matching a projectile impact for a firearm to an aiming point of the closed reflex sight.

In typical operation, an enclosed reflex sight is secured to an upper mounting surface of a firearm via a mounting interface at a position forward of a protruding rear sight, i.e., a rear iron sight, of the firearm. In one known implementation, an upper mounting surface may include an upper surface 555 of a firearm 550 whereby a mounting interface 525 is secured directly to the upper surface 555 via one or more threaded fasteners 556 forward of a rear sight 530 (see the mounting interface 525 releasably secured to an upper surface 555 of a pistol slide 575 in FIG. 1). As shown in FIG. 2, in another known implementation an upper mounting surface 557 of a particular size and shape may be formed along an upper surface 555 of a firearm 550 for receiving a mounting interface 525 (see FIGS. 2 and 3). In this implementation, the upper mounting surface 557 commonly includes a bottom surface 570, a forward or front wall surface 571 and a rearward or back wall surface 572 located forward of a rear sight 530 operationally configured as a mounting surface envelope for receiving a mounting interface 525 for securing an enclosed reflex sight at a position forward of a rear sight 530 as shown in FIG. 3.

In each of the implementations described above, the entire enclosed reflex sight 500 is located at a point between a rear end surface 538 and a front end surface 539 of the firearm 550 on top of the mounting interface 525 forward the rear sight 530 whereby the mounting interface 525 spaces the enclosed reflex sight apart from the upper mounting surface of the firearm. Because the elevation adjustment mechanism of a known enclosed reflex sight 500 as shown in FIG. 3 operates in a vertical direction, the housing must include enough space to accommodate the elevation adjustment mechanism. Unfortunately, an enlarged housing raises the location of an optical center 505 of a clear aperture or usable field of view of the enclosed reflex sight 500 in relation to both the upper mounting surface of the firearm 550 (see the bottom surface 570 of the upper mounting surface 557 in FIG. 3) and the top of the original equipment ("OE") standard height iron sights for a particular firearm thereby preventing the rear and front sights from being used for purposes of co-witnessing with the enclosed reflex sight 500 (see the sighting line 540 of the standard height rear sight 530 and front sight 531 and distance 541 in FIG. 3; also see the no-witness position between the standard height iron sights 530, 531 and the reticle 535 of the enclosed reflex sight 500 in FIG. 4). To achieve co-witnessing, the standard height iron sights 530, 531 must be replaced with taller aftermarket rear and front sights 532 and 533 as shown in FIG. 5.

In consideration of the above described enclosed reflex sight 500 design, another enclosed reflex sight 590 known in the art houses electronics and adjustment mechanisms in a rear section 591 that extends beyond the upper surface 555 of a firearm 550 behind a rear end surface 538 of a pistol slide 575 as shown in the simplified illustrations of FIGS. 6 and 7. However, as shown, an enclosed reflex sight 590 of this embodiment may require adjustment in design to accommodate pistol slide 575 geometry of a particular firearm 550. In addition, the corresponding firearm 550 does not employ a rear sight.

An enclosed reflex sight that overcomes the above shortcomings while also being operable with a plurality of firearm mounting footprints is desired.

SUMMARY OF THE DISCLOSURE

The present disclosure provides an assembly comprising an enclosed reflex sight and a mounting interface; wherein the enclosed reflex sight includes a rearward bottom portion that houses an adjustment assembly of the enclosed reflex sight and wherein the rearward bottom portion defines a lowermost surface of the enclosed reflex sight; wherein the enclosed reflex sight includes an upper bottom surface forward of the rearward bottom portion of the enclosed reflex sight, the upper bottom surface comprising an abutment surface for the mounting interface; and wherein when the assembly is secured to an upper mounting surface of a firearm then the lowermost surface of the rearward bottom portion of the enclosed reflex sight is closer to the upper mounting surface of the firearm than the upper bottom surface of the enclosed reflex sight.

The present disclosure also provides an assembly comprising an enclosed reflex sight and a mounting interface; wherein when the assembly is secured to an upper mounting surface of a firearm then the lowermost surface of the enclosed reflex sight is located at a position closer to the upper mounting surface of the firearm than at least part of the mounting interface and the assembly is located forward of a rear end surface of the firearm.

The present disclosure also provides an assembly comprising an enclosed reflex sight and a plurality of mounting interfaces; wherein each of the plurality of mounting interfaces is configured to secure the assembly to one or more of a plurality of firearms comprising a plurality of upper mounting surface footprints; wherein when the assembly is secured to an upper mounting surface of a first firearm of the plurality of firearms then the assembly is located on top of the first firearm forward of a rear end surface of the first firearm; and wherein the assembly includes a first maximum height and the enclosed reflex sight includes a second maximum height the same or substantially similar as the first maximum height.

The present disclosure also provides a system comprising (1) at least one firearm and (2) an assembly comprising (a) an enclosed reflex sight and (b) at least one mounting interface; wherein the enclosed reflex sight includes a rearward bottom portion that houses an adjustment assembly of the enclosed reflex sight and wherein the rearward bottom portion defines a lowermost surface of the enclosed reflex sight; wherein the enclosed reflex sight includes an upper bottom surface forward of the rearward bottom portion of the enclosed reflex sight, the upper bottom surface comprising an abutment surface for the at least one mounting interface; and wherein when the assembly is secured to an upper mounting surface of a firearm then the lowermost surface of the rearward bottom portion of the enclosed reflex sight is closer to the upper mounting surface of the firearm than the upper bottom surface of the enclosed reflex sight.

The present disclosure also provides a system comprising (1) at least one firearm comprising an upper mounting surface and (2) an assembly securable to the upper mounting surface comprising (a) an enclosed reflex sight and (b) at least one firearm mounting interface; wherein the assembly includes a maximum height and wherein the enclosed reflex sight includes a maximum height the same or substantially similar as the maximum height of the assembly; and wherein the assembly is located forward of a rear end surface of the firearm.

The present disclosure also provides a system comprising (1) a plurality of firearms providing at least two different upper mounting surfaces, (2) an enclosed reflex sight and (3) a plurality of mounting interfaces, each mounting interface of the plurality of mounting interfaces being configured to secure the enclosed reflex sight to at least one upper mounting surface of the at least two different upper mounting surfaces; wherein when the enclosed reflex sight is secured to the at least one upper mounting surface of a first firearm of the plurality of firearms via a first mounting interface of the plurality of mounting interfaces then the enclosed reflex sight is located on top of the first firearm forward of a rear surface of the first firearm wherein a lowermost surface of the enclosed reflex sight is located closer to the at least one upper mounting surface than at least part of the first mounting interface.

BRIEF DESCRIPTION OF THE SEVERAL VIEW OF THE DRAWING

FIG. 1 is a perspective view of a prior art mounting interface 525 secured to an upper surface 555 of a pistol slide 575 of a firearm 550.

FIG. 2 is a perspective view of a pistol slide 575 including a mounting surface 557.

FIG. 3 is a side view illustration of a prior art enclosed reflex sight 500 secured to a slide component of a semi-automatic pistol type firearm 550 via a prior art mounting interface 525.

FIG. 4 is a rear view of the enclosed reflex sight 500 of FIG. 1 in a no-witness position in relation to rear and front sights 530, 531 of the firearm 550.

FIG. 5 is a rear view of the enclosed reflex sight of FIG. 1 comprising taller prior art rear and front iron sights 532, 533 illustrating a lower ⅓ co-witness of the reticle 535 with the rear and front iron sights 532, 533.

FIG. 6 is a side view of an embodiment of a prior art enclosed reflex sight 590 for a firearm 550 including part of the enclosed reflex sight 590 located beyond or off from an upper mounting surface of a firearm 550 behind a pistol slide 575 when the firearm 550 is oriented in a firing position.

FIG. 7 is a side view of an embodiment of a prior art enclosed reflex sight 590 for a firearm 550 including part of the enclosed reflex sight 590 located beyond or off from an upper mounting surface of a firearm 550 behind a pistol slide 575 when the firearm 550 is oriented in a firing position.

DEFINITIONS USED IN THE DISCLOSURE

Figure 1:
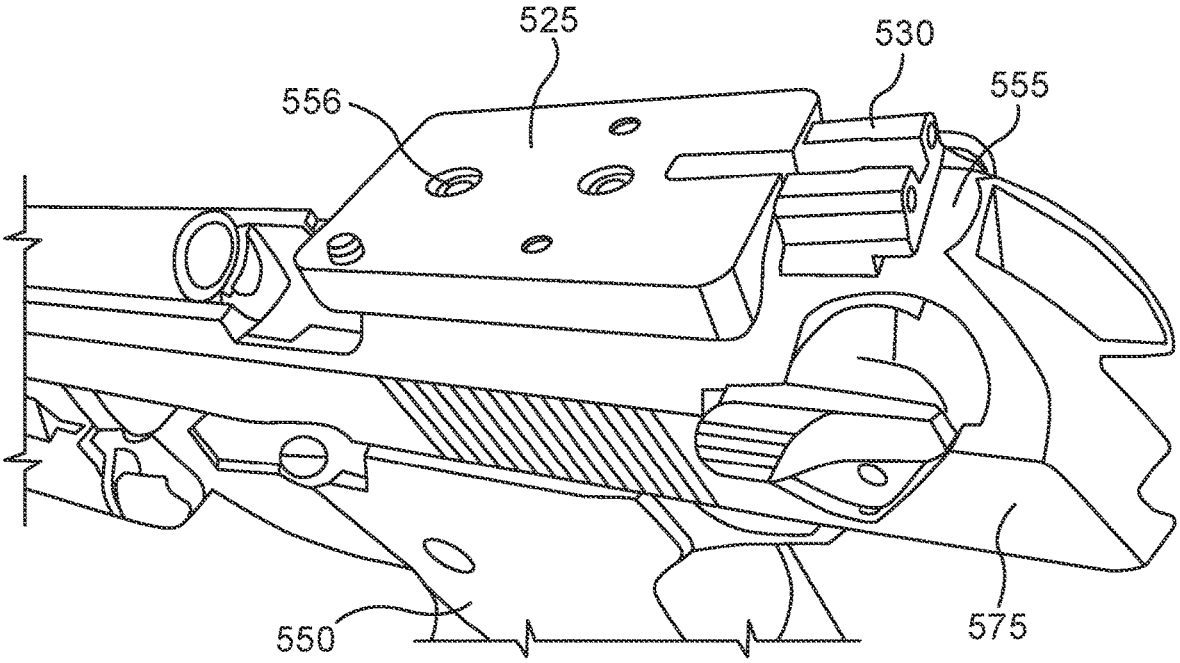
FIG. 1 (Prior Art)

The term "at least one", "one or more", and "one or a plurality" mean one thing or more than one thing with no limit on the exact number; these three terms may be used interchangeably within this disclosure. For example, at least one device means one or more devices or one device and a plurality of devices.

The term "about" means that a value of a given quantity is within ±20% of the stated value. In other embodiments, the value is within ±15% of the stated value. In other embodiments, the value is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±% of the stated value.

The term "substantially" or "essentially" means that a value of a given quantity is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value. In other embodiments, the value is within ±0.5% of the stated value. In other embodiments, the value is within ±0.1% of the stated value.

The term "and/or" includes any and all combinations of one or more of the associated listed items.

DETAILED DESCRIPTION OF THE DISCLOSURE

For the purposes of promoting an understanding of the principles of the disclosure, reference is now made to the embodiments illustrated in the drawings and particular language will be used to describe the same. It is understood that no limitation of the scope of the claimed subject matter is intended by way of the disclosure. As understood by one skilled in the art to which the present disclosure relates, various changes and modifications of the principles as described and illustrated are herein contemplated.

It is to be understood that the present disclosure is not limited to particular embodiments. It is also to be understood that the terminology used herein is for the purpose of describing particular embodiments only, and is not intended to be limiting. Herein, a "firearm" may include, but is not limited to a pistol, a semiautomatic firearm, e.g., a semiautomatic rifle, a bolt action firearm, e.g., a bolt action rifle, a shotgun, a revolver, a shoulder fired bazooka, a shoulder fired rocket launcher, an air rifle, and a paintball gun. As understood by the skilled artisan, a particular firearm may be provided in different barrel lengths. Non-limiting examples of pistols are provided in United States Patent Number U.S. Pat. No. 4,539,889, titled "Automatic Pistol with Counter-acting Spring Control Mechanism," issued on Sep. 10, 1985; and United States Patent Number U.S. D918,328 S, titled "Handgun," issued on May 4, 2021, each of which is herein incorporated by reference in its entirety. Non-limiting examples of semiautomatic rifles are provided in U.S. Pat. No. 9,777,975 B2, titled "Semiautomatic Firearm," issued on Oct. 3, 2017; and United States Patent Number U.S. Pat. No. 7,775,150 B2, titled "Law Enforcement Carbine with One Piece Receiver," issued on Aug. 17, 2010, each of which is herein incorporated by reference in its entirety.

In this disclosure, reference to an "optical sight" includes an optical sight for a firearm or a "firearm optical sight." Reference to one or more "commercially available" enclosed reflex sights and/or other optical sights includes those optical sights commercially available as of the time of this disclosure. Herein, "OE" stands for original equipment and "OEM" stands for original equipment manufacturer. In this disclosure, the terms "button cell battery," "button cell," "button style battery," "coin cell battery," "coin cell" and "coin style battery" may be used interchangeably.

Figure 2:
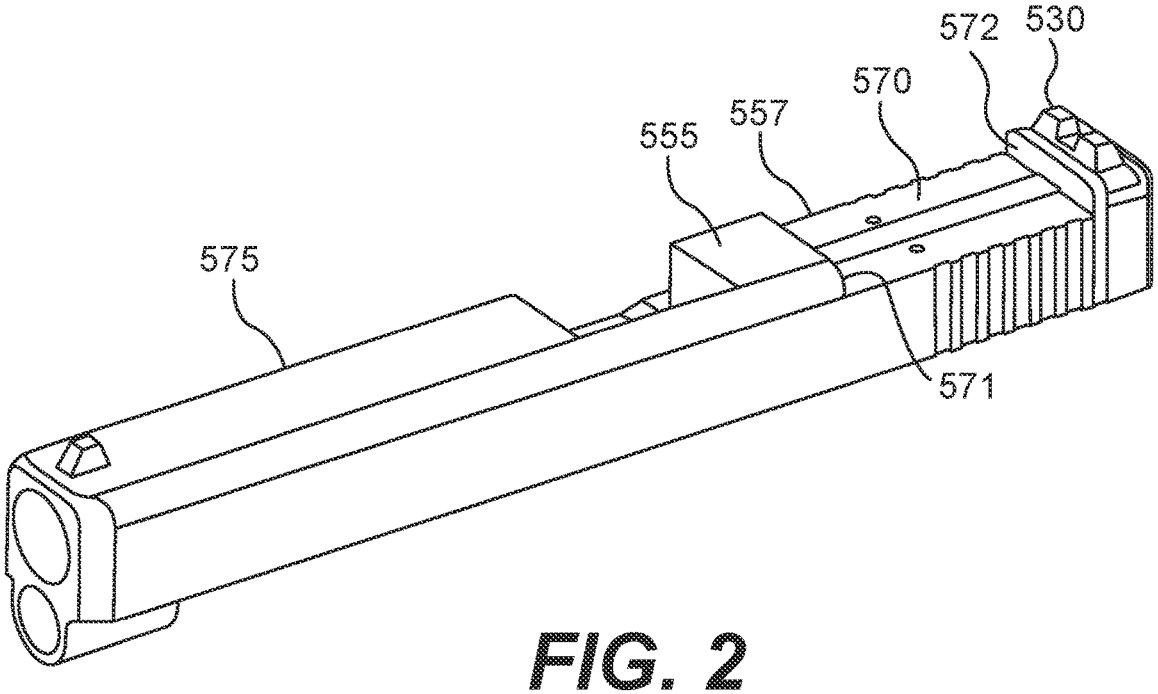
FIG. 2 (Prior Art)
Figure 3:
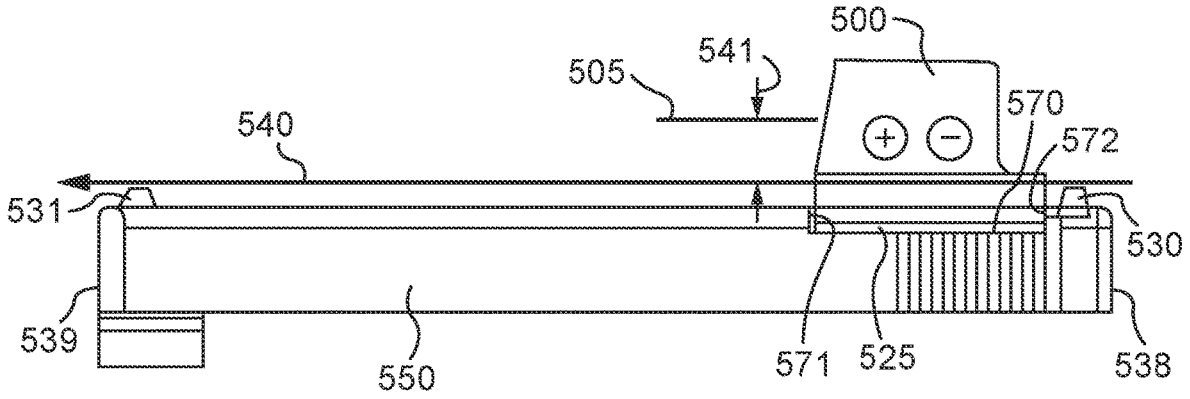
FIG. 3 (Prior Art)

Herein, an upper mounting surface of a firearm 550 for use with an enclosed reflex sight of this disclosure is a mounting surface located along an upper surface 555 of a firearm 550 between a rear sight 530 and a front end 539 of the firearm 550 for locating the entire enclosed reflex sight on top of the firearm 550 forward of the rear sight 530. In an embodiment of a firearm 550 devoid of a rear sight 530, an upper mounting surface of a firearm 550 for an enclosed reflex sight of this disclosure is a mounting surface located along an upper surface 555 of a firearm 550 from or about a rear end of the upper surface 555 of the firearm 550 forward to or about the front end of the upper surface 555 of the firearm 550 for locating the entire enclosed reflex sight on top of the firearm 550. For purposes of this disclosure, an upper mounting surface 557 as shown in FIGS. 2 and 3 may be referred to herein as an "upper mounting surface envelope" whereby an enclosed reflex sight of this disclosure alone or as part of an assembly including a corresponding mounting interface operates as an upper mounting surface inset for the upper mounting surface envelope locating the entire enclosed reflex sight or the assembly on top of a firearm 550 forward of a rear end surface 538 of a firearm 550 and also forward of a rear sight 530 of a firearm 550 when a rear sight 530 is included as part of a firearm 550.

In this disclosure, an "illuminated reticle" refers to a reticle of an optical sight that may be illuminated via electrical components including a power source and one or more electrically powered and electrically controlled light sources of the optical sight. Exemplary light sources may include, but are not limited to one or more incandescent bulbs, one or more fluorescent bulbs, one or more light emitting diodes ("LEDs"), one or more resonant cavity light-emitting diodes ("RCLEDs"), one or more diode lasers, one or more organic LEDs, one or more vertical cavity surface emitting laser diodes ("VCSELs"), and combinations thereof. In one non-limiting embodiment, a reticle may be illuminated via a light emitting diode ("LED") or an LED array and/or (2) a resonant cavity light-emitting diode ("RCLED") or an RCLED array. In another embodiment, a reticle may be illuminated via a diode laser, e.g., a reticle of a holographic optical sight. In another embodiment, a reticle may be illuminated via a liquid crystal display ("LCD"). In another embodiment, a reticle may be illuminated via an organic light-emitting diode ("OLED") display. In another embodiment, a reticle may be illuminated via a vertical cavity surface emitting laser diode ("VCSEL"). An LED of this disclosure may include a single color LED or a multi-color LED, e.g., a dual color LED, a tri-color LED. An RCLED of this disclosure may include a single color RCLED or a multi-color RCLED. An LED array of this disclosure may include one or more single color LEDs, one or more multi-color LEDs, and combinations thereof. An RCLED array of this disclosure may include one or more single color RCLEDs, one or more dual color RCLEDs, one or more tri-color RCLEDs, and combinations thereof. Exemplary LED and/or RCLED colors may include, but are not limited to red, green, yellow, blue, cyan, orange, and combinations thereof. One or more other commercially available LED and/or RCLED colors may also be employed as desired.

Herein, the phrase "field of view" ("FOV") refers to the visible or observable area through an optical element or lens or lenses of an optical sight for an operator of the optical sight, e.g., a shooter, at a particular distance between the operator's eye(s) and the optical element or lens of the optical sight. Herein, "clear aperture" refers to the smallest diameter, width, or area inside an enclosed reflex sight that creates the optical viewing area of the enclosed reflex sight.

The phrase "co-witnessing" and like terms refers to the interaction between a reticle of an optical sight and iron sights of a corresponding firearm. As understood by the skilled artisan, an optical sight comprises a co-witness when the reticle of the optical sight is aligned with the iron sights of the corresponding firearm. As used in this disclosure, the term "reticle" in relation to firearms refers to lines and/or other markings or indicia found on an optical element of an optical sight. One exemplary reticle for use with a reflex sight including an enclosed reflex sight includes a luminous marking such as a luminous dot, e.g., a red dot or other colored dot. Regarding an enclosed reflex sight of this disclosure, the phrase "operable eye distance" refers to one or more distances between a shooter's eye and a front lens of an enclosed reflex sight effective for suitable operation of a reticle projected onto the front lens of the enclosed reflex sight. As such, the field of view of the lenses of an enclosed reflex sight at an operable eye distance may be referred to herein as an "operable field of view" or "clear aperture." The operable eye distance and the operable field of view may vary depending on the optical sight and firearm combination employed. For example, an operable eye distance for an optical sight and pistol combination may be greater than an operable eye distance for an optical sight and rifle combination.

In an embodiment, the disclosure is related to an enclosed reflex sight system operable for co-witnessing with protruding iron sights of one or more firearms.

In another embodiment, the disclosure is related to an enclosed reflex sight assembly operable for co-witnessing with protruding iron sights of one or more firearms.

In another embodiment, the disclosure is related to an assembly comprising an enclosed reflex sight and a firearm mounting interface having a length less than the length of the enclosed reflex sight whereby the windage and elevation adjustment mechanisms of the enclosed reflex sight are located behind the firearm mounting interface closer to a corresponding firearm when the assembly is mounted to a firearm compared to known commercially available enclosed reflex sights whereby the present enclosed reflex sight is operable for co-witnessing with standard height iron sights.

In another embodiment, the disclosure is related to an assembly comprising an enclosed reflex sight and a firearm mounting interface operationally configured to provide a shorter and less bulky design of an enclosed reflex sight compared to known commercially available enclosed reflex sights when mounted to a firearm such as a semi-automatic pistol.

In another embodiment, the disclosure is related to an assembly comprising an enclosed reflex sight and a firearm mounting interface wherein the firearm mounting interface is located forward of a rearmost part of the enclosed reflex sight when the enclosed reflex sight is assembled to the firearm mounting interface.

In another embodiment, the disclosure is related to an assembly comprising an enclosed reflex sight and a firearm mounting interface wherein the maximum height of the enclosed reflex sight is the same or substantially similar as the maximum height of the assembly of the enclosed reflex sight and the firearm mounting interface. Said another way, the distance between the optical center of a clear aperture of the enclosed reflex sight and the bottommost surface of the enclosed reflex sight is the same or substantially similar as the distance between the optical center of the clear aperture of the enclosed reflex sight and the bottommost surface of the firearm mounting interface when the enclosed reflex sight is assembled to the firearm mounting interface. Although an assembly of this disclosure may be built to scale, in an embodiment of the assembly operationally configured for use with a semi-automatic pistol type firearm 550, any difference in the distances of the bottommost surface of the enclosed reflex sight and the bottommost surface of the firearm mounting interface is not distinguishable to the unaided eye including when the assembly is mounted to a firearm, e.g., see FIGS. 58-60. As stated above, although an assembly of this disclosure may be built to scale, in an embodiment of an assembly operationally configured for use with a semi-automatic pistol type firearm 550 any measurable difference in distance from the optical center of a clear aperture of the enclosed reflex sight to the bottommost surface of the firearm mounting interface and the bottommost surface of the enclosed reflex sight is a distance of or about 5.0 mm or less.

In another embodiment, the disclosure is related to an assembly comprising an enclosed reflex sight and a mounting interface for securing the enclosed reflex sight to at least a first firearm. In this embodiment, the enclosed reflex sight comprises windage and elevation adjustment mechanisms in a rearward bottom portion of the enclosed reflex sight wherein when the enclosed reflex sight is secured to the mounting interface then the rearward bottom portion of the enclosed reflex sight is located behind the mounting interface and wherein the windage and elevation adjustment mechanisms operate in the horizontal direction. The configuration of the windage and elevation adjustment mechanisms operating in the horizontal direction allows for an overall height reduction of the enclosed reflex sight compared to the height of prior art enclosed reflex sights.

In another embodiment, the disclosure is related to an assembly comprising an enclosed reflex sight and a firearm mounting interface. In another embodiment, when the enclosed reflex sight is secured to the firearm mounting interface and mounted to a firearm oriented in a firing position, a lowermost bottom surface of the rearward part of the enclosed reflex sight is located at an altitude or elevation lower than at least part of the firearm mounting interface. In another embodiment, when the enclosed reflex sight is secured to the firearm mounting interface and mounted to a firearm oriented in a firing position, the lowermost bottom surface of the forward part of the enclosed reflex sight is located at an altitude or elevation lower than at least part of the firearm mounting interface.

In another embodiment, the disclosure is related to an enclosed reflex sight for a firearm and a mounting interface for the enclosed reflex sight, wherein the enclosed reflex sight includes a bottom surface having a first bottom surface and a second bottom surface. In this embodiment, when the enclosed reflex sight and the mounting interface are mounted to a firearm that is oriented in a firing position then the first bottom surface is located at one or more first altitudes or elevations and the second bottom surface is located at one or more second altitudes or elevations lower than the one or more first altitudes or elevations, the first bottom surface comprising an abutment surface for the mounting interface. In this embodiment, the mounting interface includes a bottom surface wherein when the enclosed reflex sight is secured to the mounting interface then the bottom surface of the mounting interface is in planar alignment or substantially planar alignment with the second bottom surface of the enclosed reflex sight.

In another embodiment, the disclosure is related to an enclosed reflex sight for a firearm and a mounting interface for the enclosed reflex sight, wherein the enclosed reflex sight includes a bottom surface having a front section bottom surface and a rear section bottom surface. In this embodiment, when the enclosed reflex sight and the mounting interface are mounted to a firearm that is oriented in a firing position then the front section bottom surface is located at a first altitude or elevation and the rear section bottom surface is located at a second altitude or elevation lower than the first altitude or elevation, the front section bottom surface comprising an abutment surface for the mounting interface. In this embodiment, the mounting interface includes a bottom surface wherein when the enclosed reflex sight is secured to the mounting interface then the bottom surface of the mounting interface is in planar alignment or substantially planar alignment with the rear section bottom surface of the enclosed reflex sight.

In another embodiment, the disclosure is related to an assembly comprising an enclosed reflex sight and a firearm mounting interface with a length less than the length of the enclosed reflex sight whereby the windage and elevation adjustment mechanisms of the enclosed reflex sight are located behind the firearm mounting interface and whereby each of the adjustment mechanisms operate in a horizontal direction effective to minimize the size of the present enclosed reflex sight compared to known commercially available enclosed reflex sights comprising one or more adjustment mechanisms operating in a vertical direction.

In another embodiment, the disclosure is related to a system comprising an enclosed reflex sight and a plurality of firearm mounting interfaces configured for use with a plurality of firearms, e.g., a plurality of semi-automatic pistols, whereby the enclosed reflex sight may be used with a plurality of semi-automatic pistols. In other words, the system is operationally configured so that the enclosed reflex sight may be used with one or more optical sight mounting footprints on firearms as known in the firearm industry at the time of this disclosure.

In another embodiment, the disclosure is related to an assembly comprising an enclosed reflex sight and a firearm mounting interface whereby, when mounted to a firearm such as a semi-automatic pistol, and depending on the semi-automatic pistol used, the optical center of a clear aperture of the enclosed reflex sight is located above the firearm a distance effective for the enclosed reflex sight to be used for co-witnessing with protruding iron sights.

In another embodiment, the disclosure is related to an assembly comprising an enclosed reflex sight and a chassis type firearm mounting interface having a length less than the length of the enclosed reflex sight whereby the windage and elevation adjustment mechanisms of the enclosed reflex sight are located behind the chassis type firearm mounting interface and whereby the enclosed reflex sight is releasably fastenable to the chassis type firearm mounting interface and corresponding firearm via one or more fasteners at one or more locations forward of the location of the windage and elevation adjustment mechanisms.

In another embodiment, the disclosure is related to a system including (1) an enclosed reflex sight for a firearm, wherein the enclosed reflex sight includes a forward bottom surface and a rearward bottom surface, wherein the rearward bottom surface is a lowermost outer surface of the enclosed reflex sight, and (2) a firearm comprising an upper surface machined or milled to include a mounting interface for the forward bottom surface of the enclosed reflex sight.

FIGS. 8-31 illustrate an embodiment of an assembly 10 of the present disclosure operationally configured for use with firearms 550 including, but not limited to semi-automatic pistols. In this embodiment, the assembly 10, also referred to herein as the "enclosed reflex sight assembly 10," includes an enclosed reflex sight 11 and at least one mounting interface 14 for mounting or otherwise releasably securing the enclosed reflex sight to one or more firearms 550. In particular, the enclosed reflex sight 11 comprises a main housing 12 (or "housing 12") releasably securable to the mounting interface 14 via one or more fasteners 15 wherein the mounting interface 14 is releasably securable to one or more firearms 550 via one or more firearm rail mounts known in the art of firearms. e.g., one or more dovetail mounts, one or more fasteners, one or more intermediary mounting interfaces, and combinations thereof.

Figure 10:
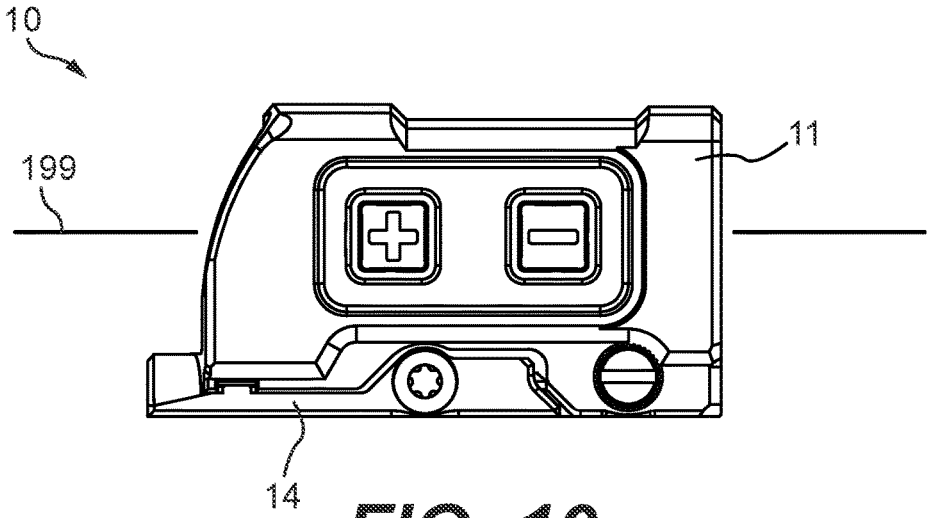
FIG. 10 is a left side elevation view of the assembly of FIG. 8.
Figure 11:
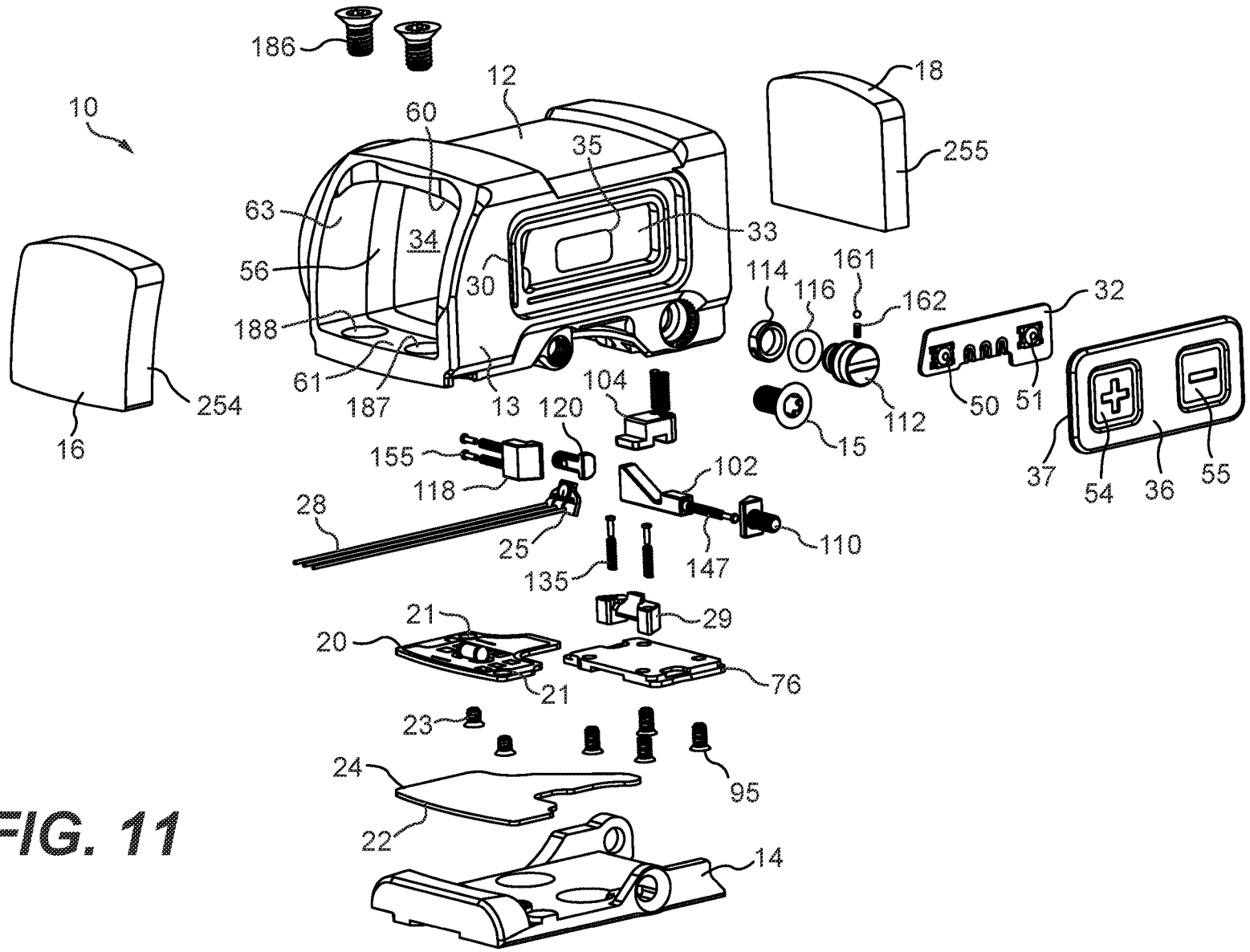
FIG. 11 is an exploded view of the assembly of FIG. 8.
Figure 12:
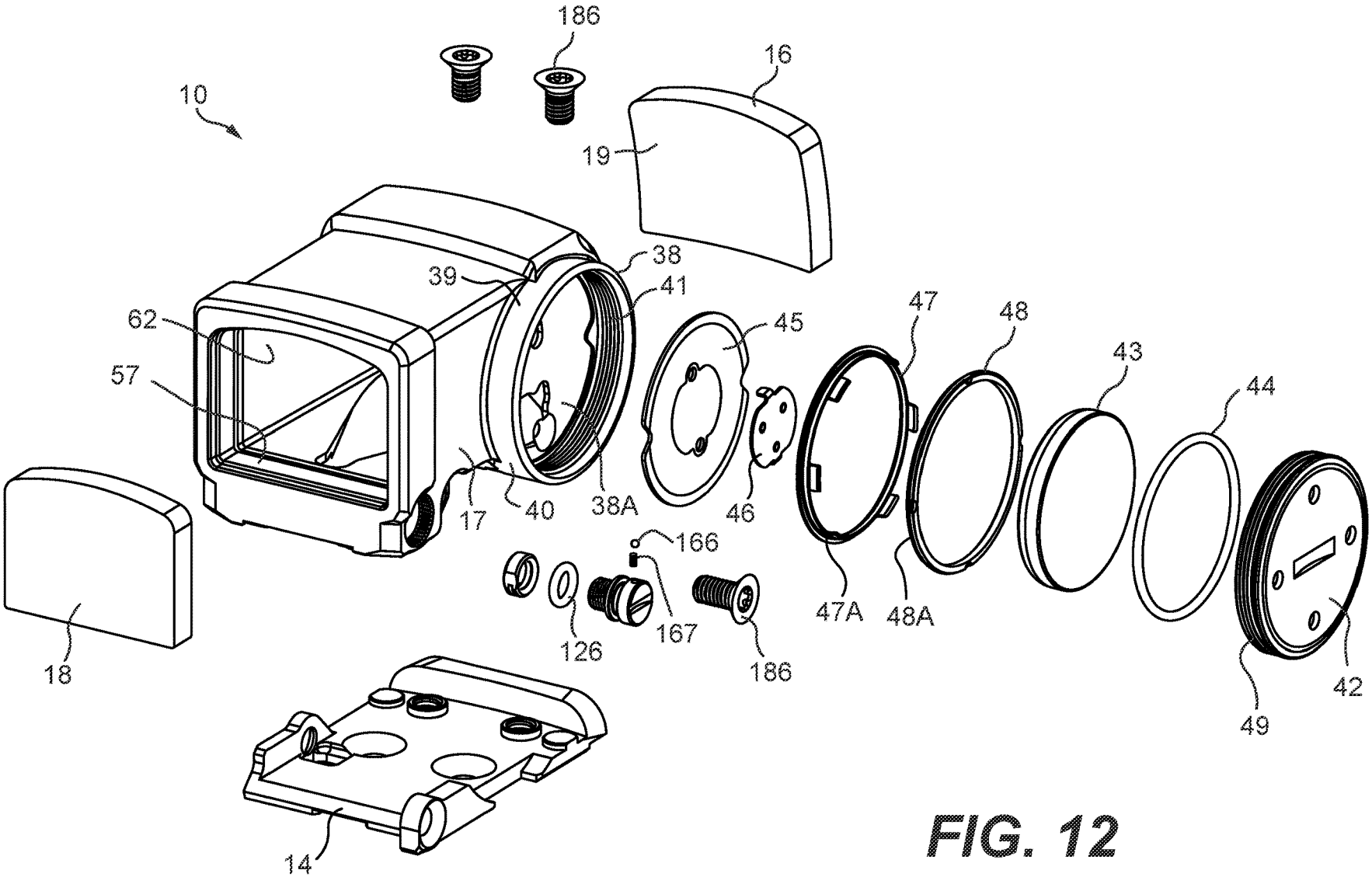
FIG. 12 is an exploded view of part of the assembly of FIG. 8.

With particular reference to FIGS. 11 and 12, the enclosed reflex sight 11 comprises a first non-magnifying optical element (hereafter "front lens 16") disposed within a forward part of the housing 12 and a second non-magnifying optical element (hereafter "rear lens 18") disposed within a rearward part of the housing 12. Suitably, the front lens 16 and the rear lens 18 are sealed within the housing 12 providing an optical space 34 there between including an optical path 199 there through (see FIG. 10). Although the one or more operating components may vary according to a desired operation of a particular enclosed reflex sight 11, in one embodiment the one or more operating components include at least control circuitry, an illumination system for a projected reticle, a power input system, and windage and elevation adjustment mechanisms. In another embodiment, an enclosed reflex sight 11 may also include one or more input/output ports, buttons, dials, switches, and combinations thereof.

With particular reference to FIGS. 11 and 12, the control circuitry may include one or more primary or main printed circuit boards 20 ("PCB 20") comprising one or more design specifications including a patterned arrangement of printed circuitry and solid state electronic components mounted to the surface of the PCB 20. As discussed further below, when supplied power via the power input system, a PCB 20 of an enclosed reflex sight 11 of this disclosure may be operationally configured to control or regulate the output power, the output voltage and the rate of electric current of the enclosed reflex sight 11, or pulse width modulation. One suitable PCB 20 may include an integrated circuit such as a microcontroller unit ("MCU"), peripheral hardware including one or more input devices and one or more other PCB components for desired operation of an enclosed reflex sight 11. A MCU of this disclosure may include, but is not limited to a central processing unit ("CPU"), random-access memory ("RAM"), flash memory, a serial bus interface, input/output ports ("I/O Ports"), a special function register ("SFR") for controlling peripheral circuitry, read-only memory ("ROM"), one or more voltage regulator circuits, one or more resistors, and combinations thereof. One or more input devices to implement one or more peripheral functions may include, but are not limited to one or more motion sensors, one or more wireless control circuits, one or more power regulation circuits, and combinations thereof.

In one embodiment, the PCB 20 may be secured within the housing 12 via one or more retaining clips, one or more threaded fasteners, one or more adhesives, and combinations thereof as known in the art of optical sights. In the embodiment as shown in FIG. 11, the PCB 20 includes one or more through holes 21 for receiving one or more threaded fasteners 23 there through for releasably securing the PCB 20 to threaded holes 52 (see FIG. 15) of the housing 12. To protect the PCB 20 and other operating components within the housing 12, the enclosed reflex sight 11 comprises a cover or plate member 22 secured to a corresponding mating surface of the housing 12 corresponding in size and shape as the plate member 22 via one or more adhesives (see FIG. 20). In one embodiment, one or more adhesives are disposed along the perimeter of an inner surface 24 of the plate member 22 for adhering the perimeter of the inner surface 24 to the mating surface 68 providing a continuous seal for insulating the PCB 20 and other components in the housing 12 from environmental influences such as dirt and moisture.

An illumination system of this embodiment includes at least an emitter assembly 25 in electrical communication with the PCB 20 and securable to an emitter assembly carrier 29, illumination circuitry including an illumination PCB 32 in electrical communication with the emitter assembly 25, and one or more user controls 36 in mechanical communication with the illumination PCB 32. In this embodiment, the emitter assembly 25 includes an emitter PCB 26 and one or more illumination sources 27 in electrical communication with the emitter PCB 26. As common in electric circuitry, the emitter assembly 25 is electrically communicated with the PCB 20 via one or more electrical connectors such as one or more wire leads 28 providing power and logic signals to the emitter PCB 26.

In one embodiment, the one or more illumination sources 27 may include one or more LEDs, one or more RCLEDs, and combinations thereof. For purpose of discussion, one non-limiting emitter assembly 25 of this disclosure may comprise one or more RCLEDs 27 operationally configured to generate a desired reticle onto an inner surface of the front lens 16. As understood by persons of ordinary skill in the art of RCLEDs, each individual RCLED of the one or more RCLEDs 27 has a positive lead at one end of the RCLED and a negative lead at an opposite end of the RCLED providing electrical communication of the one or more RCLEDs 27 with the emitter PCB 26.

As understood by persons of ordinary skill in the art of enclosed reflex sights, the emitter assembly 25 is located within the housing 12 at a location operable for projecting an operable reticle onto an inner surface 19 of the front lens 16. As such, the one or more RCLEDs 27 of the emitter assembly 25 may be provided in a size and shape effective to project a reticle of a desired angular measurement onto the inner surface 19 of the front lens 16 according to (1) the dimensions of the front lens 16 and (2) the distance between the front lens 16 and a projection point of the one or more RCLEDs 27 to provide an observable reticle at a predetermined operable eye distance for the enclosed reflex sight 11. In another embodiment, the one or more RCLEDs 27 of the emitter assembly 25 may be provided in a size and shape effective to project a reticle of a desired angular measurement onto the inner surface 19 of the front lens 16 according to (1) the dimensions of the front lens 16 and (2) the distance between the one or more RCLEDs 27 and a dichroic coating disposed between a first lens element and a second lens element of the front lens 16. In an embodiment of the emitter assembly 25 comprising one or more LEDs and an accompanying light blocking or masking element, the one or more openings of the light blocking plate may be provided in a size and shape effective to project a reticle of a desired angular measurement onto the inner surface 19 of the front lens 16 according to (1) the dimensions of the front lens 16 and (2) the distance between the front lens 16 and the one or more openings of the light blocking plate.

Suitably, the one or more user controls 36 are disposed along the housing 12 for manual operation allowing a user to manually control the illumination intensity or brightness of the one or more illumination sources 27 and a corresponding reticle of the enclosed reflex sight 11. In one embodiment, the illumination PCB 32 may include (1) a positive setting switch 50 (or "first push switch 50") operationally configured to cycle the one or more illumination sources 27 through a series of increasing reticle illumination brightness settings and (2) a negative setting switch 51 (or "second push switch 51") operationally configured to cycle the one or more illumination sources through a series of decreasing reticle illumination brightness settings.

Referring to FIG. 11, in one embodiment the one or more user controls 36 may be provided as a touch pad member 36 having a first designated push button 54 (or "first designated push area 54") operationally configured to be manually pressed inward to actuate the first push switch 50 and a second designated push button 55 (or "second designated push area 55") operationally configured to be manually pressed inward to actuate the second push switch 51. In one embodiment, a touch pad member 36 may be constructed of one or more flexible materials. In another embodiment, at least the first designated push button 54 and the second designated push button 55 of the touch pad member 36 may be constructed of one or more flexible materials. Suitable flexible materials include one or more polymeric materials, one or more metals, and combinations thereof.

As shown in FIG. 11, in one embodiment the first designated push button 54 and the second designated push button 55 of the touch pad member 36 may each include one or more numbers, one or more symbols, one or more color indicators, one or more words indicating the functions of each of the push buttons 54 and 55. In this embodiment, the outer surface of the first designated push button 54 comprises a plus sign symbol ("+") indicating the increasing reticle illumination brightness settings of the first push switch 50 and the outer surface of the second designated push button 55 comprises a minus sign symbol ("–") indicating the decreasing reticle illumination brightness settings of the second push switch 51. In another embodiment, push button 54 may include an upward pointing arrow or other indicator and push button 55 may include a downward pointing arrow or other indicator. In operation, a user may press the first designated push button 54 inward to actuate the first push switch 50 in order to cycle the one or more illumination sources 27 through a plurality of increasing illumination brightness settings and press the second designated push button 55 inward to actuate the second push switch 51 through a plurality of decreasing illumination brightness settings. In one embodiment, the first push switch 50 and the second push switch 51 may also include ON and OFF settings realized when cycling through the reticle illumination brightness settings. In one embodiment, at least one push button 54 and/or 55 may be operationally configured to cycle through a plurality of reticle configurations displaying different indicia.

With further reference to FIG. 11, the first side 13 of the housing 12 includes a cavity type mating surface 30 operationally configured to receive the illumination PCB 32 and the touch pad member 36 therein. As shown, the mating surface 30 includes a planar floor 33 operationally configured as a contact surface for the illumination PCB 32 and an opening 35 in the floor 33 providing for electrical communication between the illumination PCB 32 and the emitter assembly 25 and the PCB 20 located within the housing 12 via electrical connectors or solder joints disposed through the opening 35. Exemplary electrical connectors may include PCB wire-to-board connectors including electrical wiring and/or ribbon cable assemblies as known in the art of printed circuit boards. In another embodiment, the mating surface 30 may comprise a non-planar floor. In another embodiment, the mating surface 30 may include a plurality of openings there through.

In one embodiment, the illumination PCB 32 may be secured to the floor 33 of the mating surface 30 via one or more fasteners, one or more adhesives, and combinations thereof. In another embodiment, the illumination PCB 32 may be set in a fixed position via the touch pad member 36 when secured to housing 12 as shown FIGS. 8, 10 and 20. In this embodiment, the illumination PCB 32 is disposed across the opening 35 in the floor 33 with the first push switch 50 and the second push switch 51 positioned apart at locations aligned with the push buttons 54 and 55 of the touch pad member 36 providing for operable contact between a pressed push button 54 or 55 and a corresponding push switch 50 or 51.

In one embodiment, the touch pad member 36 may include an outer perimeter 37 having a size and shape corresponding to the mating surface 30 providing a seal there between when assembled. In one embodiment, the touch pad member 36 may be secured to the mating surface 30 via a snap-fit connection. In another embodiment, the touch pad member 36 may be secured to the mating surface 30 via one or more adhesives, e.g., one or more adhesives applied along the outer perimeter 37 of the touch pad member 36 for sealing the outer perimeter 37 to the mating surface 30.

Referring to FIG. 12, a power input sub-assembly of the enclosed reflex sight 11 may include a cylindrical battery compartment 38 operationally configured to hold a circular coin cell battery 43 as known in the art of optical sights. In one embodiment, the battery compartment 38 may be located on a second side 17 of the housing 12 as shown and comprise an assembly of battery compartment components as commonly included as part of a coin cell battery compartment 38. In this embodiment, the second side 17 of the housing 12 includes a circular opening with a raised circular perimeter 39 extending out from the second side 17 of the housing 12 as a circular sidewall at a distance providing a cavity having inner dimensions suitable for housing battery compartment components and at least one coin cell battery 43 therein during operation. Because commercially available coin cell batteries known at the time of this disclosure are produced in various sizes, i.e., various diameters and heights, the raised circular perimeter 39 and battery compartment components housed therein may be manufactured to hold a coin cell battery 43 of predetermined dimensions for powering the enclosed reflex sight 11 according to voltage requirements of the control circuitry of the enclosed reflex sight 11.

Exemplary battery compartment components housed within the raised circular perimeter 39 include at least a battery compartment PCB 45 with a negative terminal 46 for a coin cell battery 43 attachable to the battery compartment PCB 45, a positive terminal 47 or "positive terminal ring 47" for a coin cell battery 43, a PCB retaining ring 48 for retaining the battery compartment PCB 45 and the positive terminal ring 47 within the battery compartment 38, a removable threaded battery cover 42 comprising a removable polymeric seal 44. e.g., a rubber O-ring, for sealing a coin cell battery 43 within the battery compartment 38 to protect the coin cell battery 43 against environmental influences such as dirt and moisture. In this embodiment, the battery compartment PCB 45, the positive terminal ring 47, the PCB retaining ring 48, the removable seal 44 are each provided as circular type member with an outer diameter suitable for operation with an inner surface 41 of a raised circular perimeter 39 and a coin cell battery 43 of known dimensions. For example, as known in the art of coin cell battery compartments for optical sights, the negative terminal 46 (or "negative contact plate") is operationally configured to contact an anode case of a coin cell battery 43 and the positive terminal ring 47 includes an inner surface operationally configured to contact a positive terminal such as a cathode case of a coin cell battery 43 to complete an electric circuit when the coin cell battery 43 is housed within the battery compartment 38. A description of a coin cell battery for use with optical sights and a description of coin cell battery compartments of optical sights is provided in U.S. Pat. No. 11,236,971 B2, titled "Solar Powered Cap Assembly for Optical Sighting Systems," issued on Feb. 1, 2022, which is herein incorporated by reference in its entirety.

In one non-limiting embodiment, the inner surface of the battery compartment 38 may comprise dimensions suitable for housing a CR2032 3.0 Volt (20.0 mm×3.2 mm) coin cell lithium battery as a power source of the enclosed reflex sight 11. In another non-limiting embodiment, the inner surface of the battery compartment 38 may comprise dimensions suitable for housing a CR1632 3.0 Volt (16.0 mm×3.2 mm) coin cell lithium battery as a power source of the enclosed reflex sight 11.

With further reference to FIG. 12, components of the power input sub-assembly described above are assembled together within the battery compartment 38 by placing the assembled battery compartment PCB 45 and negative terminal 46 against a floor 38A of the battery compartment 38 with the positive terminal ring 47 sandwiched between the battery compartment PCB 45 and the PCB retaining ring 48. In one embodiment, the positive terminal ring 47 may include an outward annular flange 47A operationally configured as an abutment surface for the PCB retaining ring 48. In one embodiment, the PCB retaining ring 48 may include an outer threaded surface 48A operationally configured to threadedly communicate with a threaded inner surface 41 of the raised perimeter 39 of the battery compartment 38 whereby the PCB retaining ring 48 may be threadedly communicated with the threaded inner surface 41 in a manner effective to form a close fit of the battery compartment PCB 45, positive terminal ring 47, and PCB retaining ring 48 within the battery compartment 38. As further shown in FIG. 12, a battery cover 42 may include a threaded surface 49 along the outer perimeter of the battery cover 42 for threadedly mating with a threaded inner surface 41 of the raised perimeter 39 of the battery compartment 38 in a manner effective to secure a coin cell battery 43 in the battery compartment 38 and maintain the electric circuit during operation of the enclosed reflex sight 11. In another embodiment, the outer surface 40 of the raised perimeter 39 may include a threaded surface for threadedly mating with a threaded inner surface of a corresponding battery cover 42.

In one embodiment, each of the negative terminal 46 and the positive terminal 47 for a coin cell battery 43 are in electrical communication with the battery compartment PCB 45 via direct contact and the battery compartment PCB 45 may be electrically communicated with the PCB 20 via electrical wiring or rigid flex connectors.

Suitably, the windage and elevation adjustment mechanisms are provided as an assembly of parts operationally configured for manual adjustment of the emitter assembly carrier 29 in both a vertical direction and a horizontal direction. As described below, by configuring the windage and elevation adjustment mechanisms to operate horizontally the windage and elevation adjustments are able to be located within the housing 12 at or near the same elevation as the mounting interface 14 located below a forward part of the enclosed reflex sight 11 as opposed to being located above a mounting interface as shown in the prior art described above. As such, an assembly 10 of this disclosure is operationally configured as a low-profile enclosed reflex sight 11 for co-witnessing with standard iron sights of a firearm to which the assembly 10 is mounted.

Figure 13:
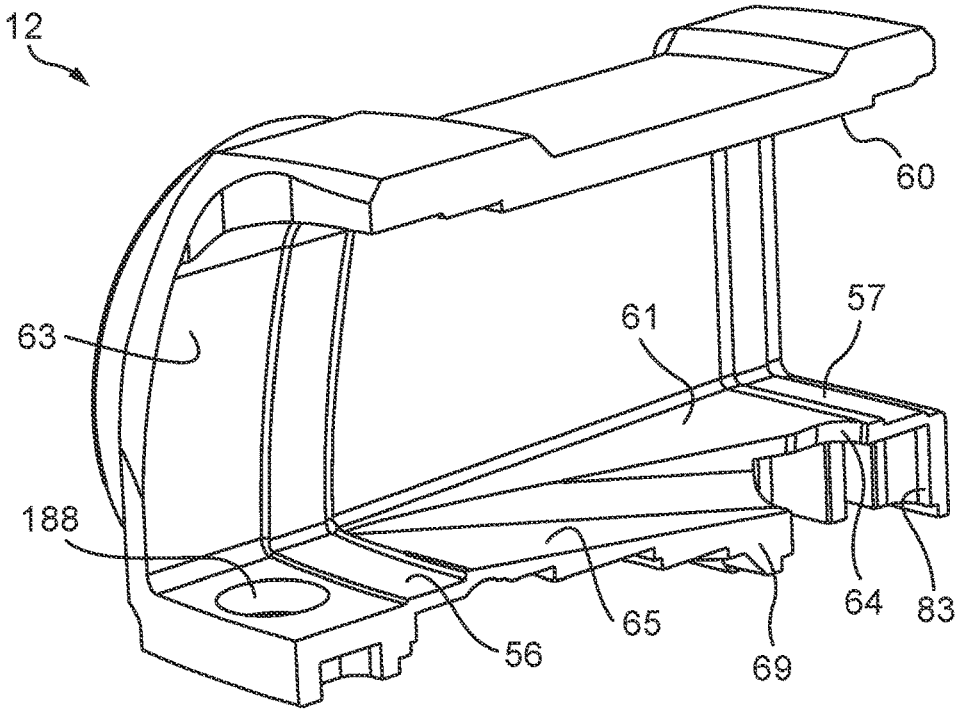
FIG. 13 is a cutaway view of the housing of the enclosed reflex sight of the assembly of FIG. 8.
Figure 14:
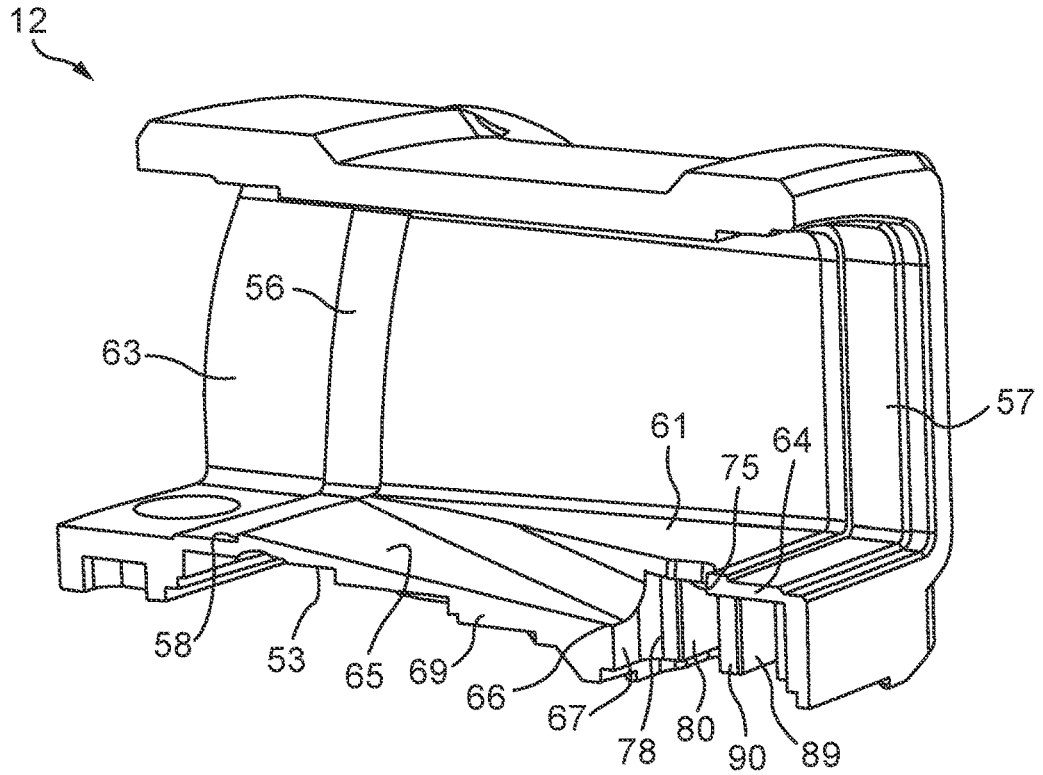
FIG. 14 is a cutaway view of the housing of the enclosed reflex sight of the assembly of FIG. 8.

With reference to FIGS. 13 and 14, a housing 12 of this disclosure generally comprises a box type inner surface including a ceiling or upper surface 60, a floor or bottom surface 61, a left sidewall or left side surface 62 (see FIG. 12) and a right sidewall or right side surface 63. In this embodiment, a forward part of the inner surface of the housing 12 comprises a front mating socket 56 for securing and aligning the front lens 16 to the inner surface of the housing 12 and a rearward part of the inner surface of the housing 12 comprises a rear mating socket 57 for securing and aligning the rear lens 18 to the inner surface of the housing 12.

In one embodiment, one or more adhesives and/or fluid sealants may be included along the front mating socket 56 to form a seal along the perimeter 254 of the front lens 16 and along the rear mating socket 57 to form a seal with the perimeter 255 of the rear lens 18. In another embodiment, one or more seals may be disposed between the front mating socket 56 and the perimeter 254 of the front lens 16 and the rear mating socket 57 and the perimeter 255 of the rear lens 18.

With further reference to FIGS. 13 and 14, the bottom of the housing 12 includes a first body member 64 with an upper surface comprising a horizontal surface of the bottom surface 61 of the housing 12 including the part of the bottom surface 61 that comprises the bottom parts the front mating socket 56 and the rear mating socket 57. The bottom of the housing 12 also includes a second body member 69 having an outer surface that forms part of the bottom outer surface 53 of the housing 12 and an inner surface 65 that forms part of the bottom surface 61 of the housing 12. In this embodiment, the inner surface 65 comprises a funnel type sloping surface that extends downward from an innermost flange 58 of the front mating socket 56 to a transition 66 characterized by a vertical surface 67 extending down from the transition 66 forming part of a forward sidewall of a compartment 70 for holding the emitter assembly carrier 29 and the windage and elevation adjustment mechanisms (hereafter collectively referred to as the "adjustment assembly 100"), which are operationally configured to move the emitter assembly 25 within the compartment 70 both vertically and horizontally.

Figure 15:
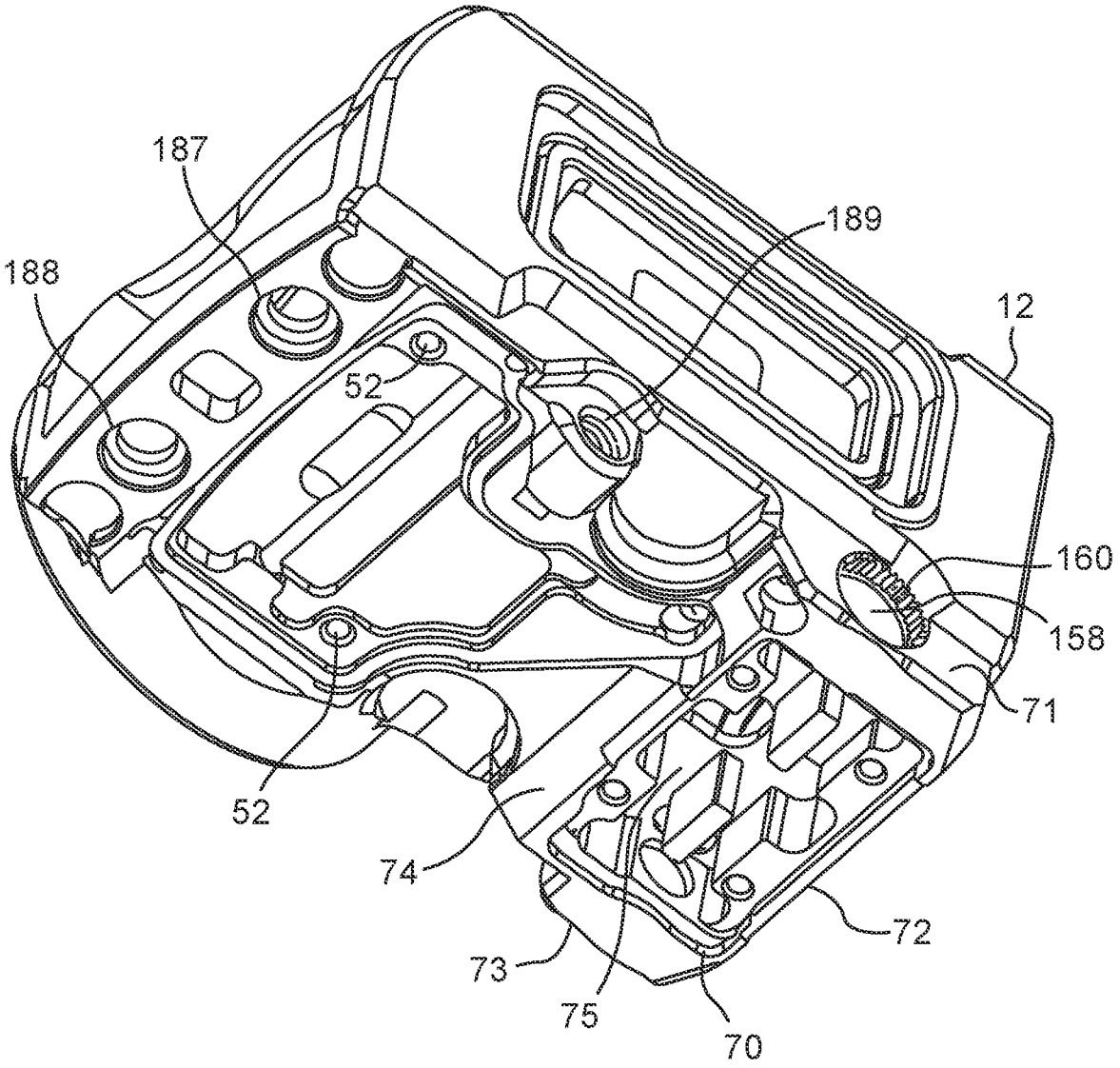
FIG. 15 is a bottom perspective view of part of the enclosed reflex sight of the assembly of FIG. 8.

Referring to FIG. 15, the compartment 70 is provided as an open space with perimeter sidewalls 71-74 in a rectangular configuration and an upper surface or ceiling 75 disposed there between. In this embodiment, the compartment 70 comprises an inner surface having a plurality of engagement surfaces for receiving an adjustment assembly 100 of a particular size and shape in abutment thereto when the adjustment assembly 100 is sealed within the compartment via a bottom plate 76 fastened to the housing 12 (see FIG. 21) wherein the bottom plate 76 acts as a floor of the compartment 70 during operation of the enclosed reflex sight 11. In another embodiment, the configuration of the compartment 70 may vary to accommodate a different size and/or shape emitter assembly 25 and/or adjustment assembly 100.

Figure 16:
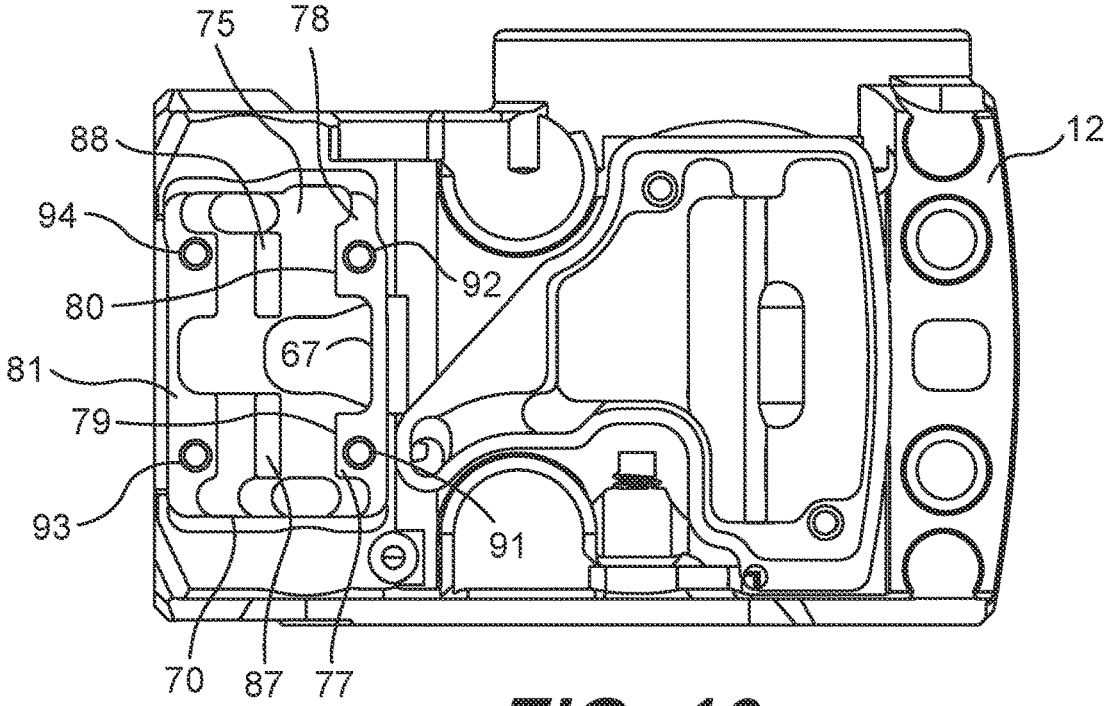
FIG. 16 is a bottom view of part of the enclosed reflex sight of the assembly of FIG. 8.
Figure 17:
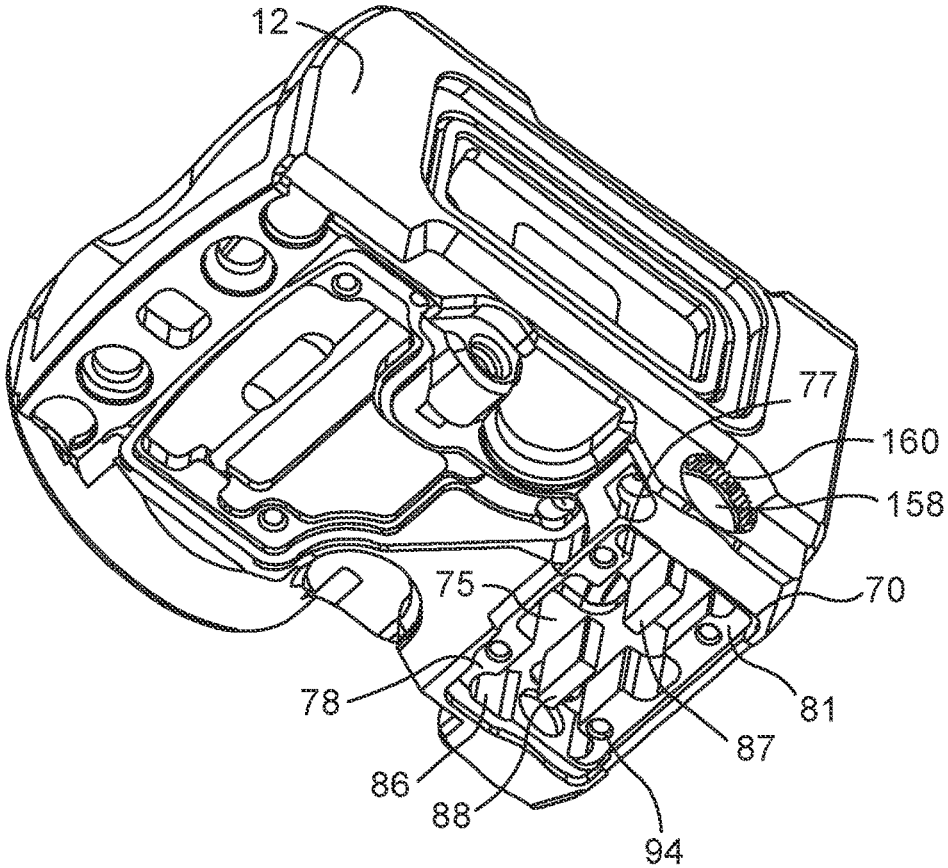
FIG. 17 is a bottom perspective view of part of the enclosed reflex sight of the assembly of FIG. 8.
Figure 18:
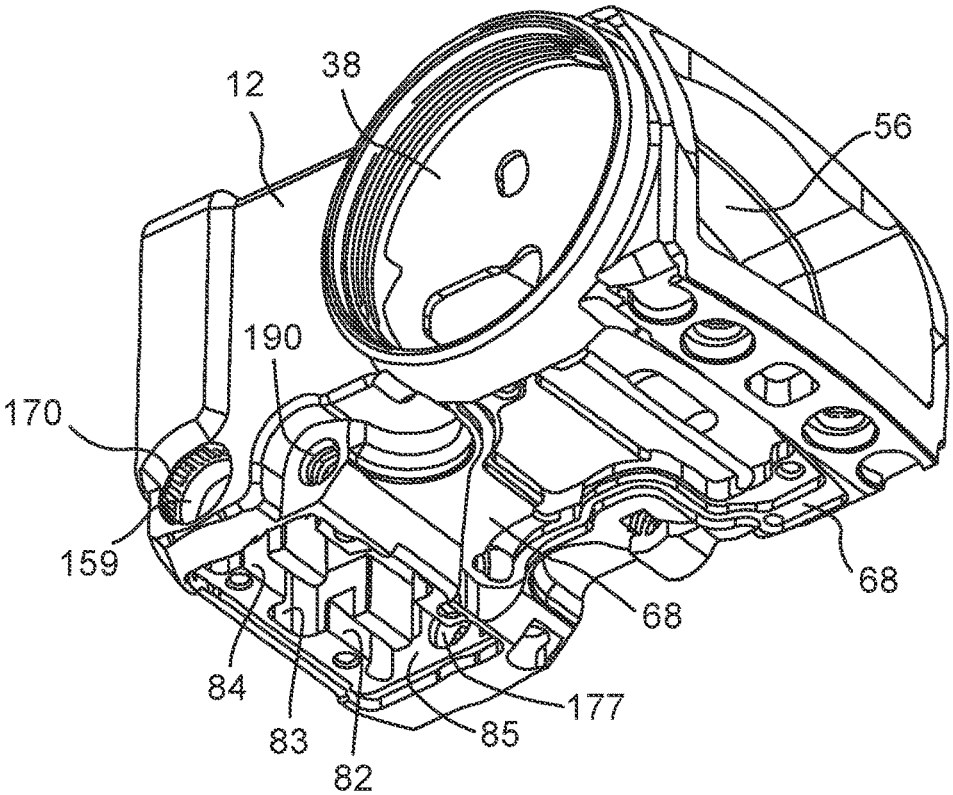
FIG. 18 is a bottom perspective view of part of the enclosed reflex sight of the assembly of FIG. 8.
Figure 19:
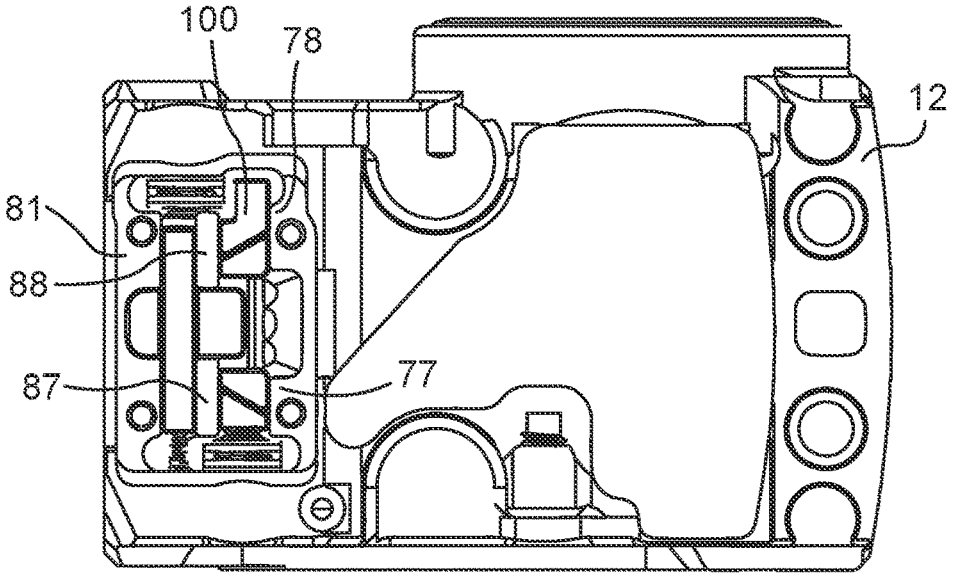
FIG. 19 is a bottom view of part of the enclosed reflex sight of the assembly of FIG. 8.

Referring to FIGS. 14 and 16, in one embodiment an inner surface of a forward sidewall 74 of the compartment 70 may include forward engagement members 77 and 78 on opposing sides of the transition 66 and the vertical surface 67. In this embodiment, the engagement members 77 and 78 extend down from the ceiling 75 from a point higher than the transition 66 whereby the engagement members 77 and 78, the transition 66 and the ceiling 75 form an opening between the compartment 70 and the optical space 34 of the housing 12. Suitably, an emitter assembly 25 is located in the compartment 70 at a point effective to project an operable reticle through the opening onto the inner surface 19 of the front lens 16 without encumbrance.

Referring to FIGS. 15-20, the forward engagement members 77 and 78 include vertical forward engagement surfaces 79 and 80 for receiving front parts of the adjustment assembly 100 in abutment thereto. The compartment 70 includes one or more rear engagement members 81 comprising one or more vertical rear engagement surfaces 82-84 operationally configured to receive at least part of a rear part of the adjustment assembly 100 in abutment thereto. In this embodiment, the left sidewall 71 includes an inner surface 85 for receiving at least part of a left side part of the adjustment assembly 100 in abutment thereto and the right sidewall 73 includes an inner surface 86 for receiving at least part of a right side part of the adjustment assembly 100 in abutment thereto. The compartment 70 may also include one or more intermediate engagement members 87 and 88 extending out from the ceiling 75 having one or more vertical surfaces, e.g., see vertical surfaces 89 and 90 in FIG. 14, operationally configured to receive one or more other parts of the adjustment assembly 100 in abutment thereto (see the embodiment of the adjustment assembly 100 housed within the compartment 70 in FIGS. 19 and 20).

Figure 20:
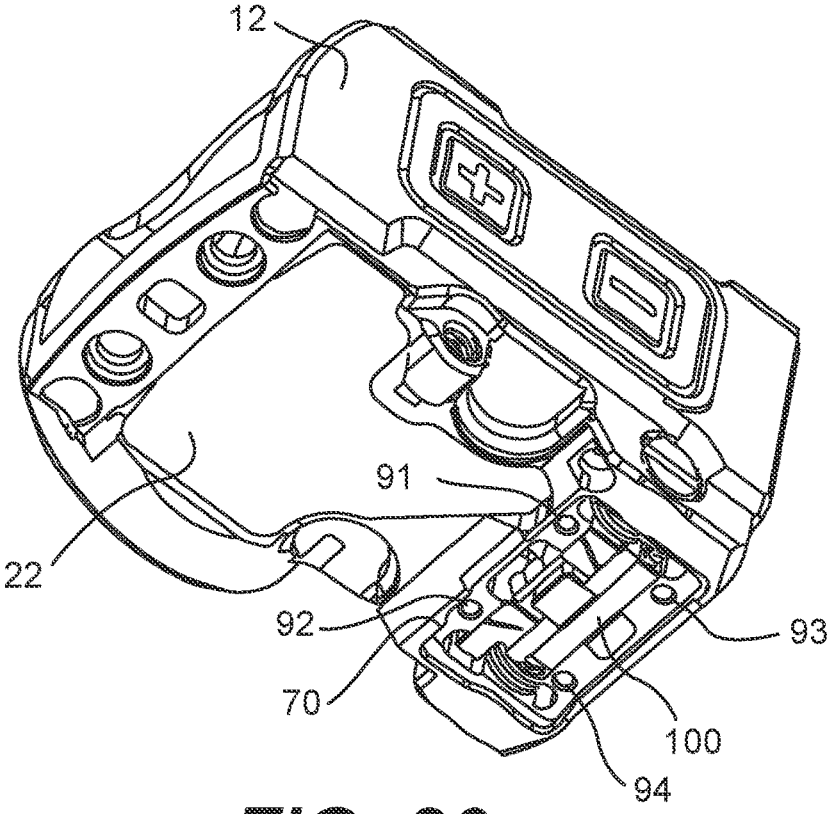
FIG. 20 is a bottom perspective view of part of the enclosed reflex sight of the assembly of FIG. 8.
Figure 21:
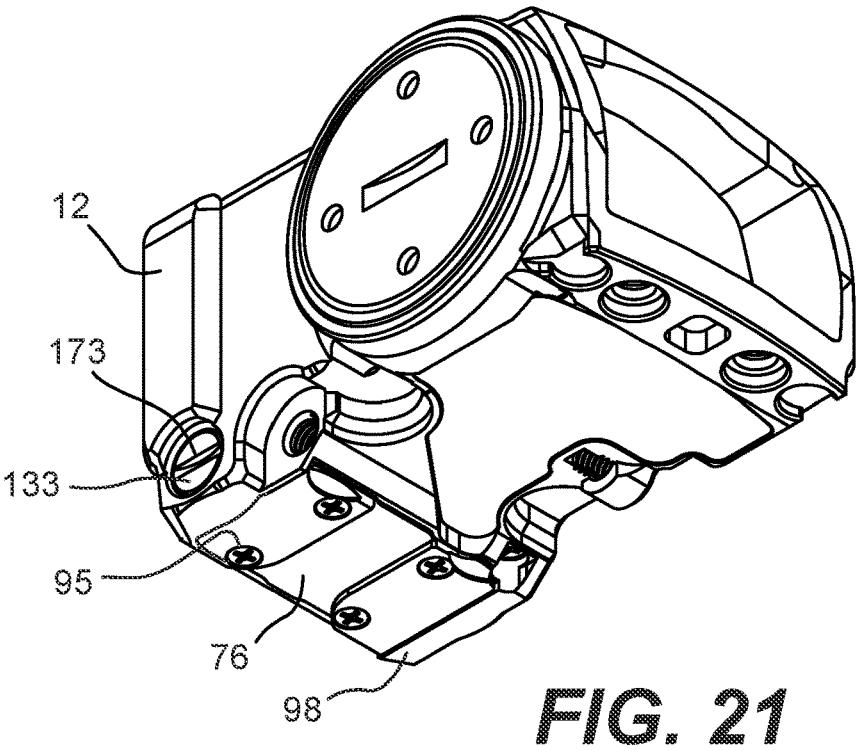
FIG. 21 is a bottom perspective view of the enclosed reflex sight of the assembly of FIG. 8.
Figure 22:
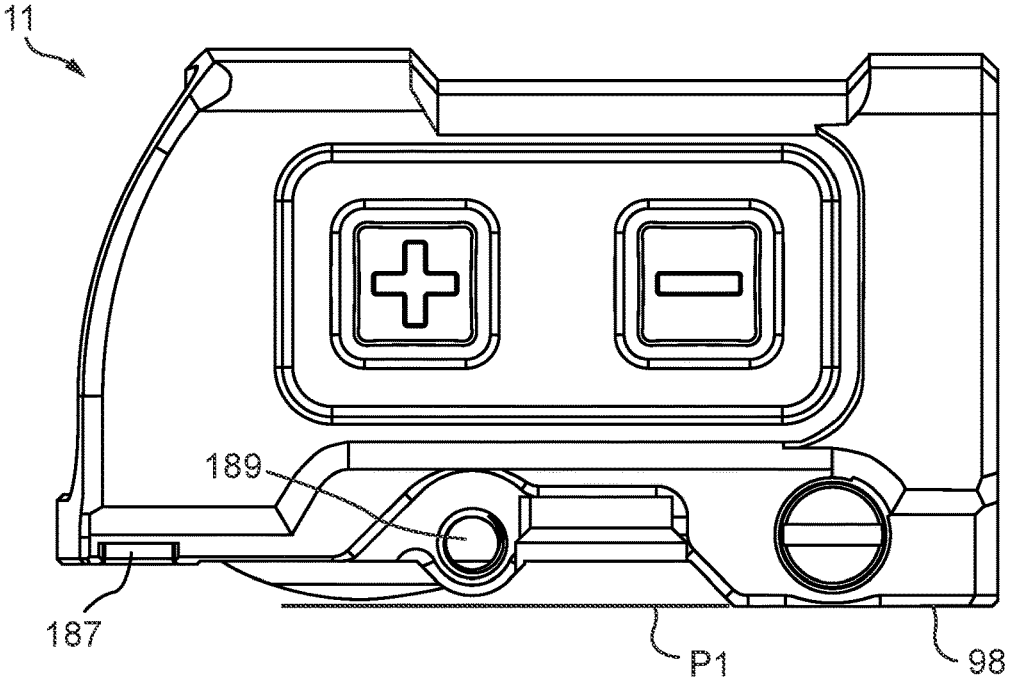
FIG. 22 is a left side elevation view of the enclosed reflex sight of the assembly of FIG. 8.
Figure 23:
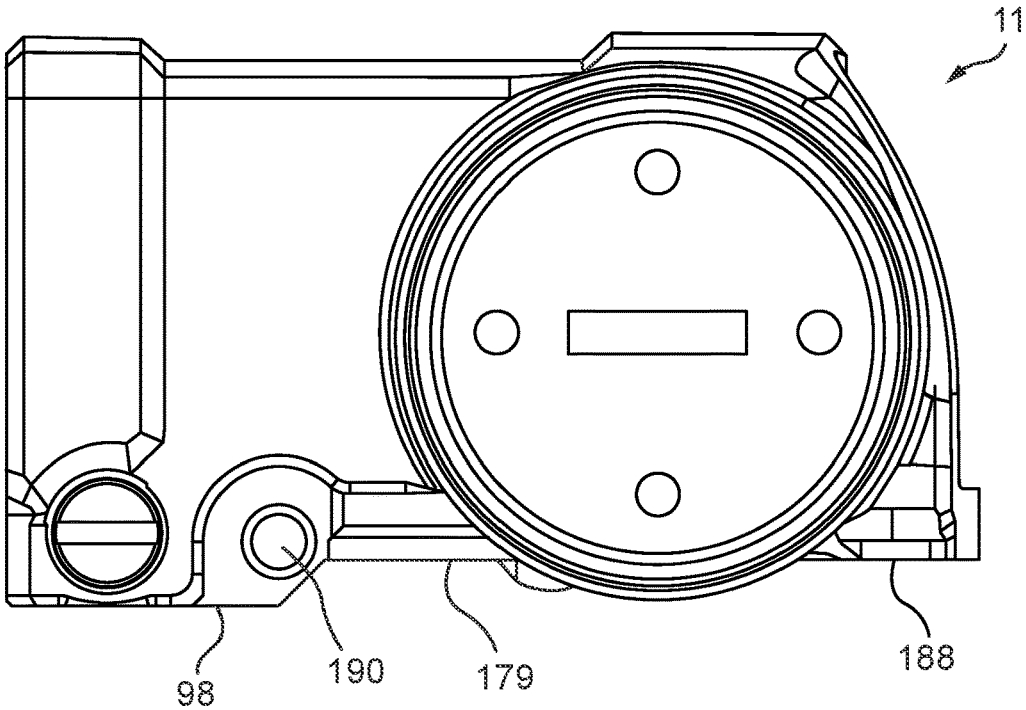
FIG. 23 is a right side elevation view of the enclosed reflex sight of the assembly of FIG. 8.
Figure 30:
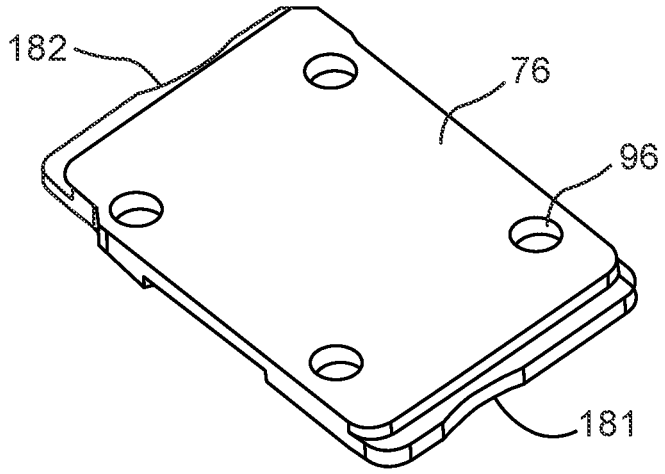
FIG. 30 is a perspective view of the bottom plate of FIG. 26.
Figure 31:
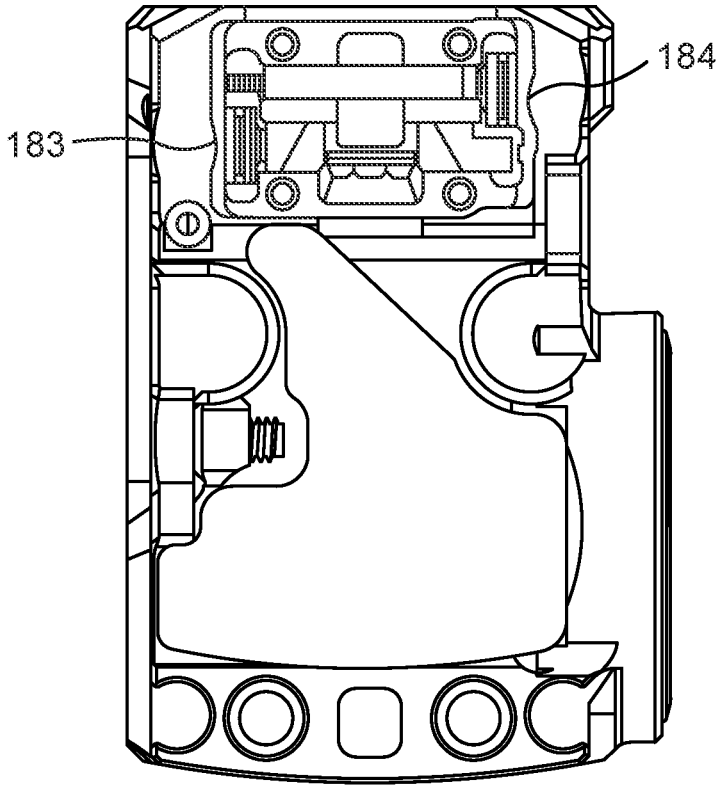
FIG. 31 is a bottom view of part of the enclosed reflex sight of the assembly of FIG. 8.

As shown in FIG. 20, in one embodiment the forward engagement surfaces 79 and 80 and the one or more rear engagement members 81 (see FIG. 16) may include threaded fastener holes 91-94 for receiving bottom plate fasteners 95 for releasably securing the bottom plate 76 to the compartment 70 (see through holes 96 of the bottom plate 76 in FIG. 30).

Figure 24:
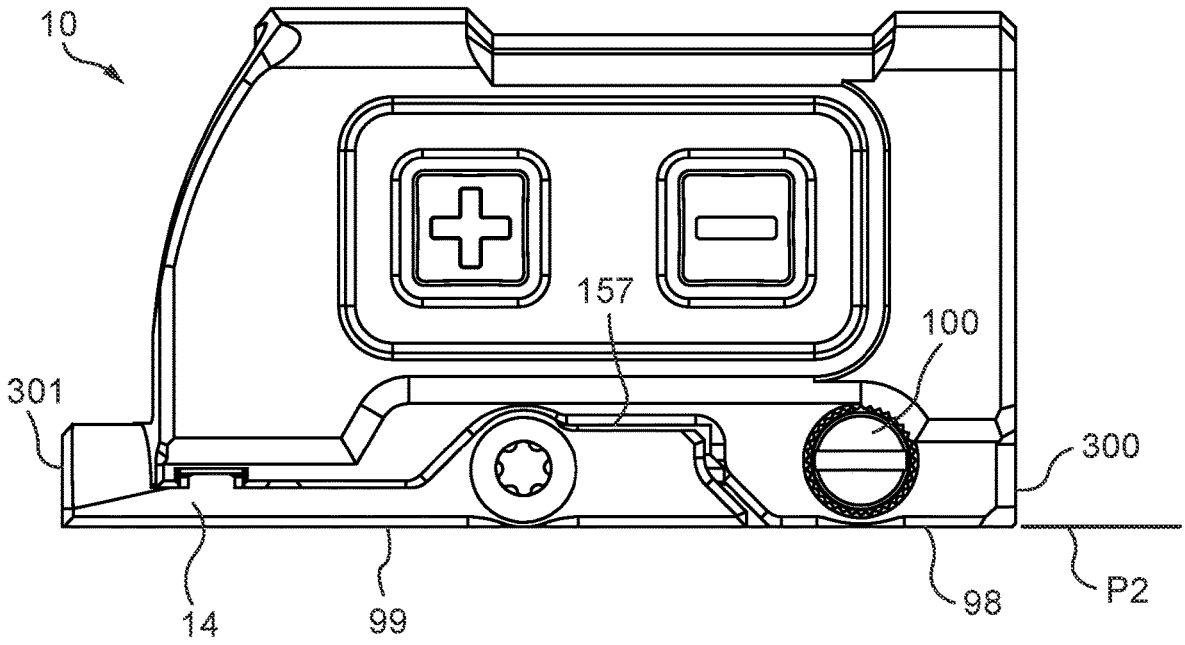
FIG. 24 is a left side elevation view of the assembly of FIG. 8.
Figure 25:
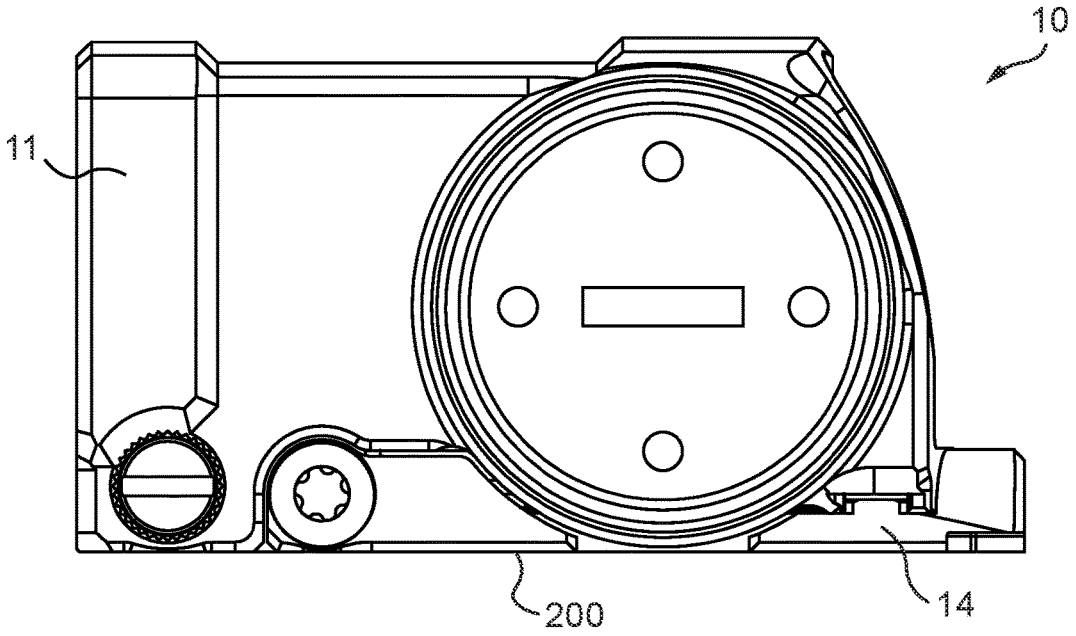
FIG. 25 is a right side elevation view of the assembly of FIG. 8.

As stated above, an adjustment assembly 100 of this disclosure includes a windage adjustment mechanism and an elevation adjustment mechanism both of which operate along a horizontal path effective to drive an emitter assembly carrier 29 of the adjustment assembly 100 both vertically up and down and horizontally left and right. The configuration of the windage adjustment mechanism and the elevation adjustment mechanism allows the compartment 70 to be located at a point along the bottom rear of the housing 12 whereby the bottom surface 98 of the compartment 70. i.e., the bottom surface of the perimeter sidewalls 71-74, is the lowermost surface of the housing 12 and the lowermost surface of the enclosed reflex sight 11 (see plane P1 in FIG. 22; see also FIG. 23). In other words, the configuration of the windage adjustment mechanism and elevation adjustment mechanism provides an adjustment assembly 100 that can be located in a compartment 70 comprising a bottom surface 98 forming a planar surface or a substantially planar surface with the bottom surface 99 of the mounting interface 14 when assembled (see plane P2 in FIG. 24). As FIGS. 24 and 25 illustrate, the mounting interface 14 does not extend the entire length of the enclosed reflex sight 11. Rather, the entire adjustment assembly 100 is located within the compartment 70 at a position behind the mounting interface 14 wherein at least part of the adjustment assembly 100 is located below the uppermost surface 157 of the mounting interface 14. As such, the bottom surface 200 of the assembly 10 is comprised of both the lowermost surface of the enclosed reflex sight 11, i.e., bottom surface 98, and the bottom surface 99 of the mounting interface 14 wherein the bottom surface 200 of the assembly 10 comprises a planar surface or a substantially planar surface operationally configured as an abutment surface with a bottom surface 570 of an upper mounting surface 557 of one or more firearms 550. In one embodiment, the bottom surface 98 may be referred to as a rearward bottom surface of the enclosed reflex sight 11 and a bottom surface 179 of the housing 12 forward of the bottom surface 98 may be referred to as a forward bottom surface of the housing 12 (see FIG. 23). In one embodiment, the bottom surface 179 may be referred to as a first bottom surface or upper bottom surface of the enclosed reflex sight 11 and the bottom surface 98 may be referred to as a second bottom surface or lowermost surface of the enclosed reflex sight 11. In one embodiment, the bottom plate 76 may be referred to as part of the bottom surface 98. In one embodiment, the plate member 22 may be referred to as part of the forward bottom surface 179 of the enclosed reflex sight 11. In addition, a rear surface 300 of the enclosed reflex sight 11 may be referred to as the rear surface of the assembly 10 and a front surface 301 of the mounting interface 14 may be referred to as the front surface of the assembly 10. Referring to FIGS. 57-60, the front surface 301 may sit adjacent to or in abutment with at least part of the front wall surface 571 of an upper mounting surface 557 and the rear surface 300 may sit adjacent to or in abutment with at least part of the back wall surface 572 of an upper mounting surface 557 of a firearm 550.

Figure 26:
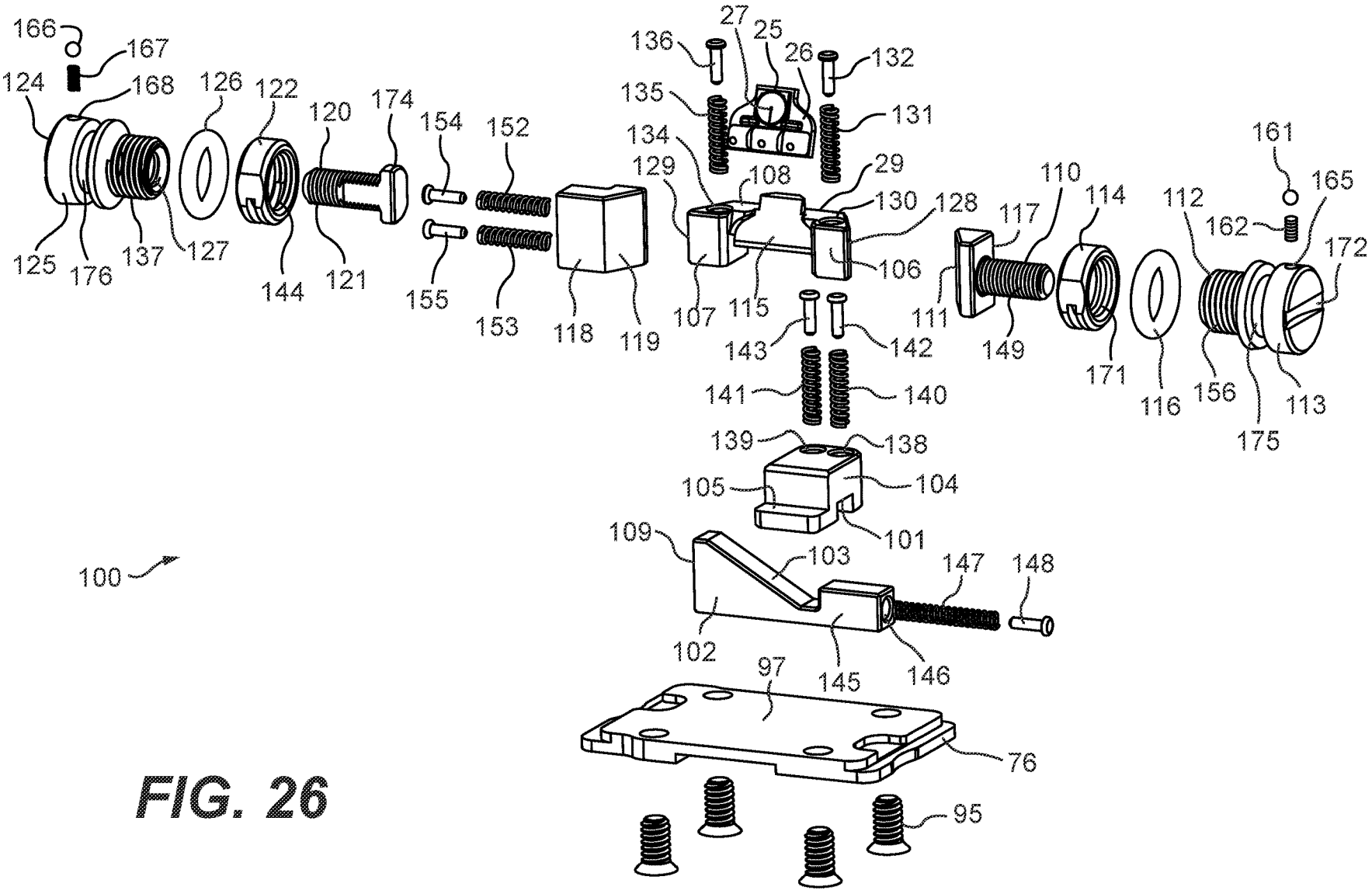
FIG. 26 is an exploded view of an adjustment assembly and bottom plate of the enclosed reflex sight of the assembly of FIG. 8.
Figure 27:
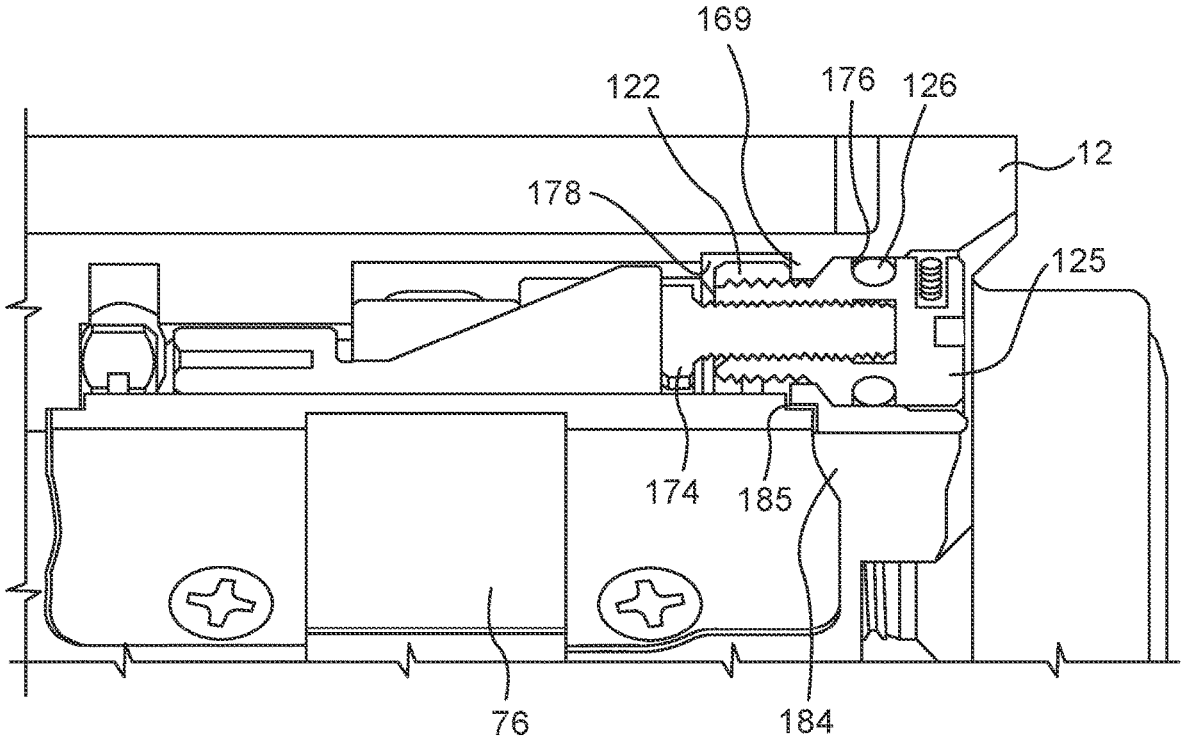
FIG. 27 is a perspective sectional view of part of the adjustment assembly of FIG. 26.
Figure 28:
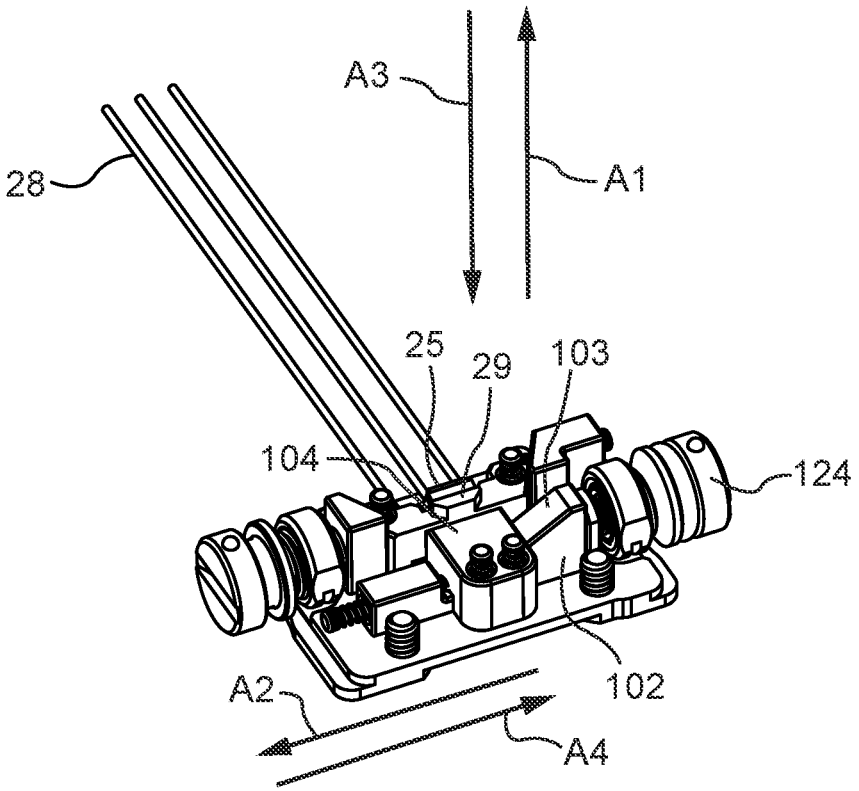
FIG. 28 is a perspective view of the adjustment assembly of FIG. 26.
Figure 29:
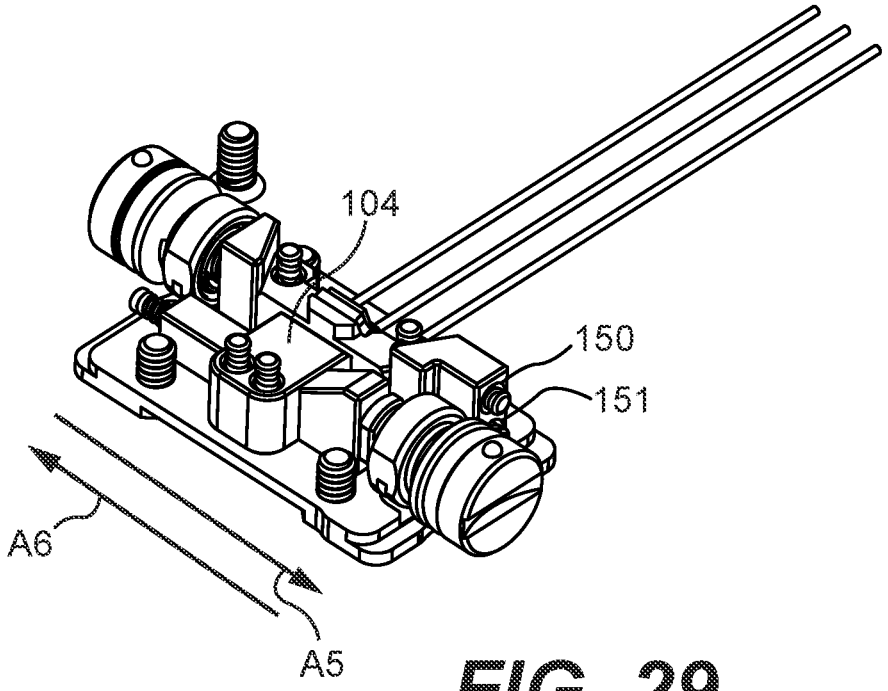
FIG. 29 is a perspective view of the adjustment assembly of FIG. 26.

FIGS. 26-28 depict an embodiment of an adjustment assembly 100 operable with a housing 12 as described above. The adjustment assembly 100 includes an assembly of components including wedges, inclined plane surfaces or ramps, threaded members, and biasing members assembled in a manner whereby the adjustment assembly 100 is greater in width than in height suitable for operation within a compartment 70 as described above. As previously discussed above, an inner surface 97 of the bottom plate 76 acts as a floor of the compartment 70. As such, the bottom plate 76 is operationally configured as a support surface for the adjustment assembly 100 and may be considered part of the adjustment assembly 100 for purposes of this disclosure.

Looking at FIG. 26, the adjustment assembly 100 includes an elevation ramp member 102 and an emitter seat 104 having a bottom facing ramp surface 101 operationally configured to ride on a corresponding ramp surface 103 of the elevation ramp member 102. As shown, the emitter seat 104 also includes a forward ledge type support surface 105 ("forward ledge 105") for holding an emitter assembly carrier 29, which acts as a support for holding the emitter assembly 25.

In addition to the emitter assembly carrier 29, windage adjustment of the emitter assembly 25 is accomplished via windage adjustment components including (1) a threaded windage drive screw 110, (2) a threaded windage adjustment key 112 for threadedly mating with the windage drive screw 110, (3) a threaded windage retaining ring 114 for threadedly mating with the windage adjustment key 112, (4) an O-ring seal 116 attachable to the windage adjustment key 112 and (5) a windage wedge member 118 operationally configured to bias the emitter assembly carrier 29 and the windage drive screw 110 as described below.

In addition to the emitter assembly carrier 29, the elevation ramp member 102 and the emitter seat 104, elevation adjustment of the emitter assembly 25 is accomplished via elevation adjustment components including (1) a threaded elevation drive screw 120, (2) a threaded elevation retaining ring 122, (3) a threaded elevation adjustment key 124, and (4) an O-ring seal 126 for the elevation adjustment key 124.

In this embodiment, the emitter assembly carrier 29 includes a central support member 108 with opposing abutment members, e.g., a first abutment member 106 with a first wedge contact face 128 operationally configured to communicate with a wedge contact face 111 of a head 117 of the windage drive screw 110 and an opposing second abutment member 107 with a second wedge contact face 129 operationally configured to communicate with a wedge contact face 119 of the windage wedge member 118. As shown, the central support member 108 includes a front planar face member 115 for receiving an emitter assembly 25 in abutment thereto via one or more adhesives. Suitably, the first abutment member 106 and the second abutment member 107 are spaced apart a distance effective to hold the forward ledge 105 in abutment there between preventing unwanted lateral movement of the emitter seat 104 when the emitter seat 104 is biased by the elevation ramp member 102 as described below. As such, in one embodiment the emitter assembly carrier 29 may be considered part of the windage adjustment mechanism of the adjustment assembly 100.

Still referring to FIG. 26, the adjustment assembly 100 comprises a plurality of biasing springs and corresponding plungers that apply tension to the inner surface of the compartment 70 to assist in maintaining the windage adjustment components and the elevation adjustment components in desired positions within the compartment 70 during operation of the adjustment assembly 100. For example, the first body member 128 of the emitter assembly carrier 29 includes a vertical hole 130 for receiving a biasing spring 131 and a plunger 132 therein and the second body member 107 includes a vertical hole 134 for receiving a biasing spring 135 and a plunger 136 therein to bias the emitter assembly carrier 29 apart from the ceiling 75 of the compartment 70. Likewise, the emitter seat 104 includes one or more vertical holes 138 and 139, each vertical hole being operationally configured to receive a biasing spring and a plunger therein to bias the emitter seat 104 apart from the ceiling 75 (see biasing springs 140, 141 and plungers 142, 143). In other words, when the adjustment assembly 100 is secured within the compartment 70 the emitter assembly carrier 29 and the emitter seat 104 are biased toward the bottom plate 76. In one embodiment, the inner surfaces 85 and 86 and the ceiling 75 may include cavities (not shown) for holding the distal ends of the corresponding plungers.

In this embodiment, the elevation ramp member 102 includes a raised body member 145 comprising a horizontal hole 146 for receiving a biasing spring 147 and a plunger 148 therein to bias the elevation ramp member 102 apart from the inner surface 85 of the left sidewall 71. The windage wedge member 118 also includes one or more horizontal holes 150 and 151 (see FIG. 29) for receiving a biasing spring and plunger therein to bias the windage wedge member 118 apart from the inner surface 86 of the right sidewall 73 (see biasing springs 152, 153 and plungers 154, 155).

Referring again to FIGS. 17 and 18, the adjustment assembly 100 is further secured to the compartment 70 by way of the windage adjustment key 112 and the elevation adjustment key 124 which are each communicated with apertures in the housing 12. In particular, the left sidewall 71 includes an aperture 158 with an inner cylindrical perimeter surface for mating with a circular head 113 of the windage adjustment key 112 and the right sidewall 73 includes an aperture 159 with an inner cylindrical perimeter surface for mating with a circular head 125 of the elevation adjustment key 124. In particular, the windage adjustment key 112 includes a round detent 161 and a corresponding biasing spring 162 disposed radially in a hole 165 of the circular head 113 and the elevation adjustment key 124 includes a round detent 166 and a corresponding biasing spring 167 disposed radially in a hole 168 of the circular head 125 for mating with raised splines disposed 360.0 degrees along the inner perimeter surface of each of the apertures 158 and 159 (see the raised splines 160 and 170 in FIGS. 17 and 18). In operation, the detents 161 and 166 operate as ball plungers that are biased between the raised teeth 160 and 170 under spring tension necessary to hold the windage adjustment key 112 and the elevation adjustment key 124 in a fixed position until manually turned to disengage the detents 161 and 166 when adjusting the windage and/or elevation. In addition, the configuration of the detents 161, 166 and the raised teeth 160, 170 produces a clicking sound and/or a clicking feel to a user when turning the windage adjustment key 112 and the elevation adjustment key 124.

In one embodiment, the circular heads 113 and 125 of the windage adjustment key 112 and the elevation adjustment key 124 may each comprise a drive 172, 173 to assist in manually turning the adjustment keys 112 and 124, e.g., using a slotted flat blade screw driver or an adjustment tool as known in the art of optical sights. In addition, a shank of each of the adjustment keys 112 and 124 may include a concentric groove adjacent the circular heads 112 and 125 for holding an O-ring seal 116, 126 to form a seal along the inner surfaces 177, 178 of the apertures 158 and 159 to protect against environmental influences such as dirt and moisture from entering the housing 12 through the apertures 158 and 159 (see grooves 175 and 176 in FIG. 26).

In one embodiment, the windage retaining ring 114 is permanently fixed to an outer threaded surface 156 of the adjustment key 112 and the elevation retaining ring 122 is permanently fixed to an outer threaded surface 137 of the adjustment key 124 whereby the windage retaining ring 114 and the elevation retaining ring 122 are operationally configured to further secure the adjustment assembly 100 to the housing 12 by similarly acting as stop type members preventing the windage adjustment key 112 and the elevation adjustment key 124 from exiting out from the apertures 158, 159. For example, referring to the elevation adjustment key 124 as shown in FIG. 27, the inner surface 178 of the aperture 159 includes a concentric flange 169 operationally configured as an abutment surface for the elevation retaining ring 122 whereby the concentric flange 169 and the elevation retaining ring 122 operate collectively as a stop for catching the head 174 of the elevation drive screw 120 preventing the elevation adjustment key 124 from being directed out from the housing 12 through the aperture 159. The elevation retaining ring 122 and the flange 169 are also operationally configured to maintain the outer face 133 of the circular head 125 of the elevation adjustment key 124 flush with the adjacent outer surface of the housing 12 (see FIG. 21). A similar flange in the inner surface 177 of aperture 158 and the windage retaining ring 114 operate as described above to prevent the head 117 of the windage drive screw 110 from being directed out from the housing 12 through the aperture 158.

To minimize the overall size of the enclosed reflex sight 11, the housing 12 materials including the bottom plate 76 and adjustment assembly 100 components are suitably configured in as small a package allowable for desired functioning of the enclosed reflex sight 11 without realizing structural failure of one or more of the housing 12, bottom plate 76 and adjustment assembly 100 components. As an example, the perimeter of the bottom plate 76 and the perimeter of the opening of the compartment 70 may include corresponding indexing features 181, 182 and 183, 184 (see FIGS. 30 and 31) in order to provide added material thickness to the bottom plate 76 and the bottom surface 98 of the compartment 70 at an abutment 185 between the bottom plate 76 and the bottom surface 98 for providing structural strength to the lower most part of the flange in each of the apertures 158 and 159 (see FIG. 27).

To adjust the emitter assembly 25 vertically up and down, the elevation adjustment key 124, which comprises a shaft having (1) an inner threaded surface 127 in threaded communication with an outer threaded surface 121 of a shaft of the elevation drive screw 120 and (2) an outer threaded surface 137 in threaded communication with an inner threaded surface 144 of the elevation retaining ring 122 may be turned clockwise and counter-clockwise thereby acting on the outer threaded surface 121 to direct the elevation drive screw 120 in a linear direction. For example, to direct the emitter assembly 25 linearly in an upward direction (see directional arrow A1 in FIG. 28), the elevation adjustment key 124 may be turned counter-clockwise directing the head 174 of the elevation drive screw 120 linearly toward the inner surface 85 of the left sidewall 71 against a right side vertical surface 109 of the elevation ramp member 102 (see directional arrow A2 in FIG. 28) causing the ramp surface 103 of the elevation ramp member 102 to act on the ramp surface 101 of the emitter seat 104 pushing the emitter seat 104 upward (see directional arrow A1) via a sliding coupling between the ramp surface 101 and the ramp surface 103. As the emitter seat 104 is directed in an upward direction, the emitter assembly carrier 29 and the emitter assembly 25 secured thereto are simultaneously directed in an upward direction a distance equal to the distance traveled by the emitter seat 104. Suitably, the detent 166 and biasing spring 167 are operationally configured to engage the raised splines 170 to assist in fixing the location of the emitter assembly 25, biasing springs 152, 153 and plungers 154, 155 during use of the enclosed reflex sight 11.

To direct the emitter assembly 25 in a downward direction (see directional arrow A3 in FIG. 28), the elevation adjustment key 124 may be turned clockwise as desired to direct the elevation drive screw 120 linearly toward the inner surface 86 of the right sidewall 73 whereby the elevation ramp member 102 is simultaneously directed linearly toward the inner surface 86 of the right sidewall 73 via a biasing force of the biasing spring 147 mated to the elevation drive screw 120 allowing the emitter seat 104 to slide down the ramp surface 103 to a desired elevation of the emitter assembly 25 along the ramp surface 103. Accordingly, rotational movement of the elevation adjustment key 124 is converted into linear movement of the emitter assembly 25.

To adjust the emitter assembly 25 horizontally left and right, the windage adjustment key 112, which comprises a shaft having (1) an inner threaded surface (not shown) similar as inner threaded surface 127 in threaded communication with an outer threaded surface 149 of a shaft of the windage drive screw 110 and (2) an outer threaded surface 156 in threaded communication with an inner threaded surface 171 of the windage retaining ring 114 may be turned clockwise and counter-clockwise thereby acting on the outer threaded surface 149 to direct the windage drive screw 110 in a linear direction. For example, to direct the emitter assembly 25 linearly toward the inner surface 86 of the right sidewall 73 (see directional arrow A5 in FIG. 29), the windage adjustment key 112 may be turned counter-clockwise directing the wedge contact face 111 of the head 117 of the windage drive screw 110 linearly against the first wedge contact face 128 of the first abutment member 106 of the emitter assembly carrier 29 to direct the emitter assembly carrier 29 toward the inner surface 86 of the right sidewall 73 according to (1) a sliding coupling between the wedge contact face 111 of the head 117 of the windage drive screw 110 and the first wedge contact face 128 of the first abutment member 106 and (2) a sliding coupling between the second wedge face 129 of the second abutment member 107 and the wedge face 119 of the windage wedge member 118, which further directs each of the emitter assembly carrier 29 and the windage wedge member 118 linearly toward the inner surface 86 of the right sidewall 73.

To direct the emitter assembly 25 toward the inner surface 85 of the left sidewall 71 (see directional arrow A6 in FIG. 29), the windage adjustment key 112 may be turned clockwise as desired to direct the windage drive screw 110 linearly toward the inner surface 85 of the left sidewall 71, whereby a biasing force of the biasing springs 152, 153 of the windage wedge member 118 directs the wedge face 119 of the windage wedge member 118 against the second wedge face 129 of the second abutment member 107, which further directs the first wedge face 128 of the first abutment member 106 against the wedge face 111 of the head 117 of the windage drive screw 110 in a sliding action until the emitter assembly 25 realizes a desired position within the compartment 70. Accordingly, rotational movement of the windage adjustment key 112 is converted into linear movement of the emitter assembly 25.

As stated above a mounting interface 14 of the assembly 10 is positioned forward of the adjustment assembly 100 housed in the compartment 70 when the mounting interface 14 is assembled to the enclosed reflex sight 11. As such, the attachment points on the enclosed reflex sight 11 for receiving a mounting interface 14 of this disclosure are also positioned forward of the adjustment assembly 100 of the enclosed reflex sight 11. As shown in FIGS. 11 and 15, the housing 12 includes two forward attachment points for a mounting interface 14 provided as fastener holes 187 and 188 disposed vertically through the first body member 64 of the housing 12 forward of the front lens 16. The housing 12 further includes a left side attachment point for a mounting interface 14 provided as a horizontal threaded fastener hole 189 located forward the adjustment assembly 100 at a point higher along the housing 12 than the bottom surface 98 (see FIG. 22) and a right side attachment point for a mounting interface 14 provided as a horizontal threaded fastener hole 190 located forward the adjustment assembly 100 at a point higher along the housing 12 than the bottom surface 98 (see FIG. 23). As further shown in FIGS. 22 and 23, the fastener holes 187 and 188 are also located at a point higher along the housing 12 than the bottom surface 98.

As stated above, an enclosed reflex sight 11 of this disclosure may be used as part of an assembly 10 with one or more mounting interfaces 14 operationally configured for use with a plurality of upper mounting surface footprints as known in the art of firearms, including one or more upper mounting surface 557 footprints on semi-automatic pistol slides, for example, one or more machined, drilled or milled surfaces of semi-automatic pistol slides. Non-limiting examples of upper mounting surface 557 footprints that the one or more mounting interfaces 14 may be configured for use with include one or more dovetail footprints, the Glock® Modular Optic System plate footprint (or "Glock® MOS" plate footprint); Glock, Inc., Smyrna. Georgia. U.S.A. and the Trijicon® RMR® Reflex Sight footprint. Trijicon, Inc., Wixom, Michigan. U.S.A.

Figure 8:
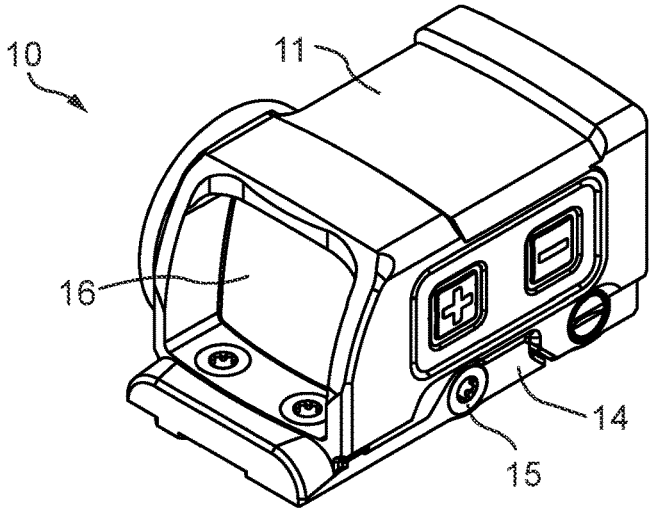
FIG. 8 is a front top perspective view of an embodiment of an assembly of the present disclosure.
Figure 9:
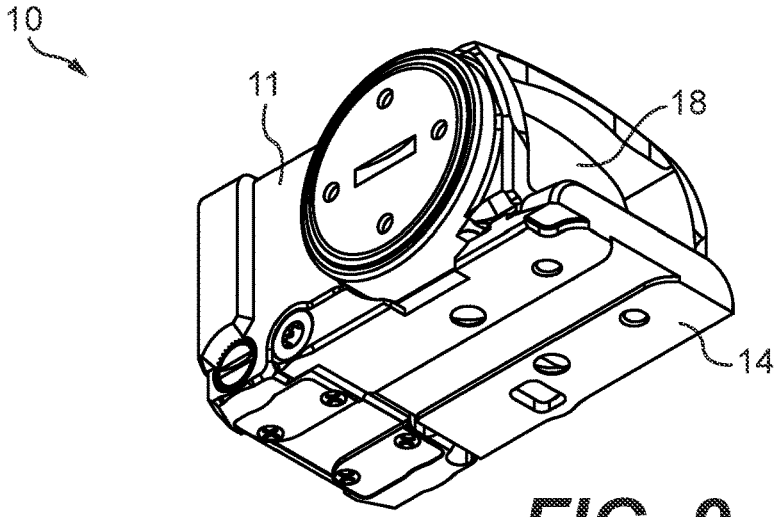
FIG. 9 is a front bottom perspective view of the assembly of FIG. 8.
Figure 32:
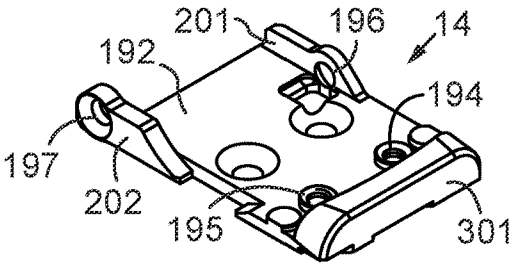
FIG. 32 is a perspective view of the mounting interface of the assembly of FIG. 8.
Figure 33:
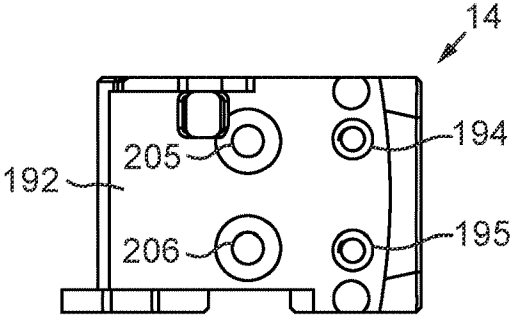
FIG. 33 is a top view of the mounting interface of FIG. 32.
Figure 34:
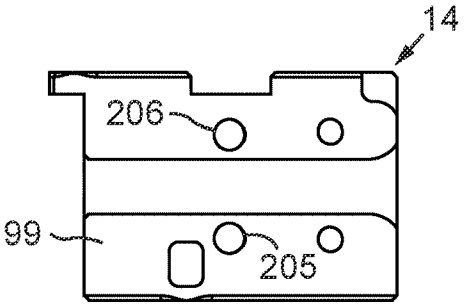
FIG. 34 is a bottom view of the mounting interface of FIG. 32.

FIGS. 32-34 illustrate a first non-limiting embodiment of a mounting interface 14 of this disclosure operationally configured for use with a Glock® MOS plate footprint. FIGS. 8-10 depict the embodiment of the mounting interface 14 of FIGS. 32-34 assembled to an enclosed reflex sight 11 of this disclosure.

Figure 35:
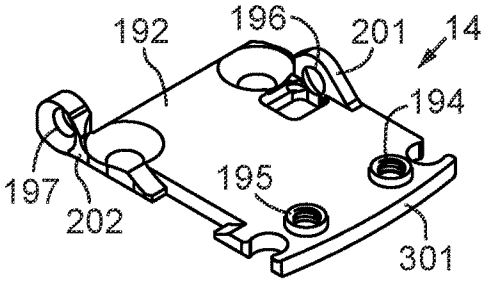
FIG. 35 is a perspective view of an embodiment of a mounting interface for assembly with the enclosed reflex sight of FIG. 8.
Figure 36:
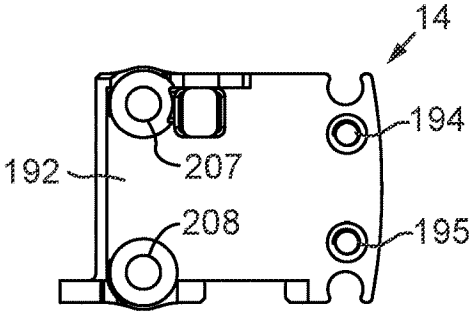
FIG. 36 is a top view of the mounting interface of FIG. 35.
Figure 37:
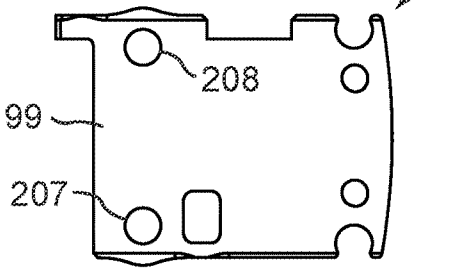
FIG. 37 is a bottom view of the mounting interface of FIG. 35.
Figure 38:
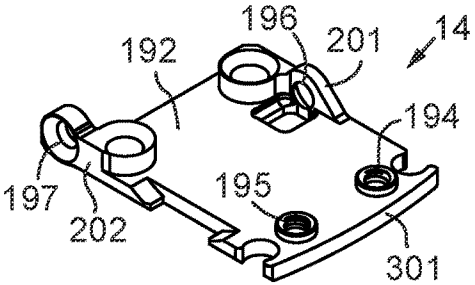
FIG. 38 is a perspective view of an embodiment of a mounting interface for assembly with the enclosed reflex sight of FIG. 8.
Figure 39:
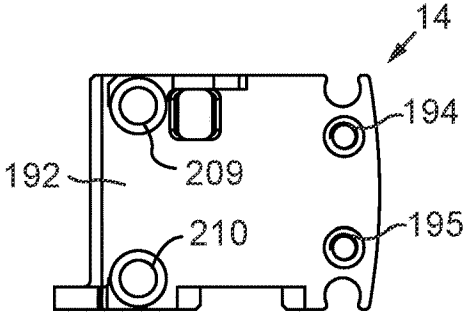
FIG. 39 is a top view of the mounting interface of FIG. 38.
Figure 40:
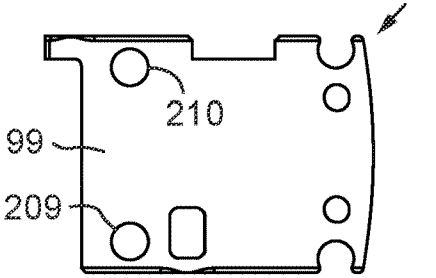
FIG. 40 is a bottom view of the mounting interface of FIG. 38.
Figure 47:
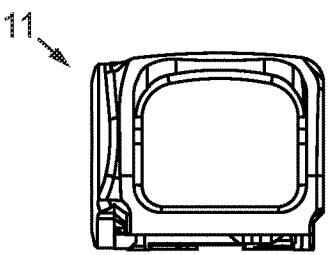
FIG. 47 is a front elevation view of the enclosed reflex sight of FIG. 41.
Figure 48:
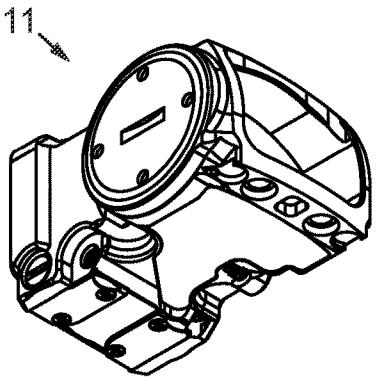
FIG. 48 is a bottom perspective view of the enclosed reflex sight of FIG. 41.
Figure 43:
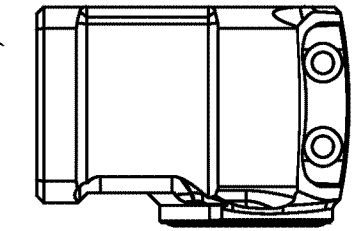
FIG. 43 is a top view of the enclosed reflex sight of FIG. 41.
Figure 44:
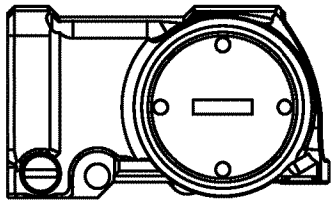
FIG. 44 is a right side elevation view of the enclosed reflex sight of FIG. 41.
Figure 45:
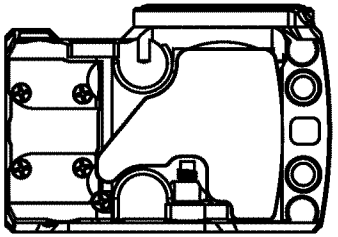
FIG. 45 is a bottom view of the enclosed reflex sight of FIG. 41.
Figure 46:
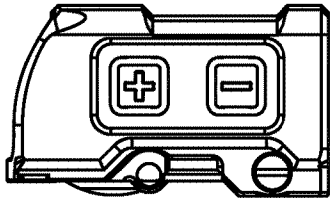
FIG. 46 is a left side elevation view of the enclosed reflex sight of FIG. 41.
Figure 41:
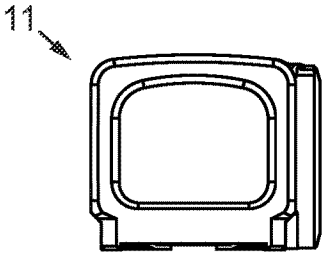
FIG. 41 is a rear elevation view of an embodiment of an enclosed reflex sight of this disclosure.
Figure 42:
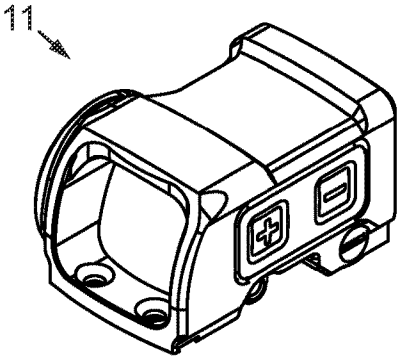
FIG. 42 is a front perspective view of the enclosed reflex sight of FIG. 41.
Figure 49:
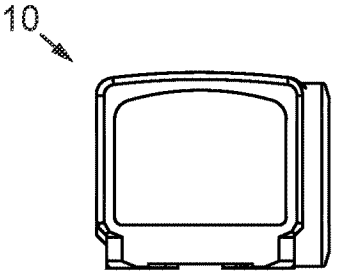
FIG. 49 is a rear elevation view of the assembly of FIG. 8.
Figure 50:
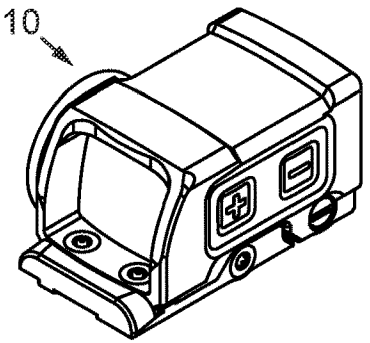
FIG. 50 is a front top perspective view of the assembly of FIG. 49.
Figure 51:
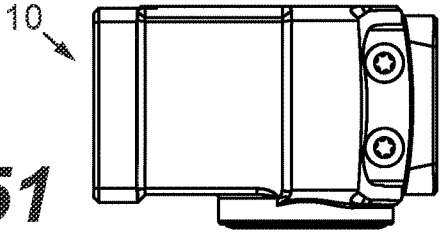
FIG. 51 is a top view of the assembly of FIG. 49.
Figure 52:
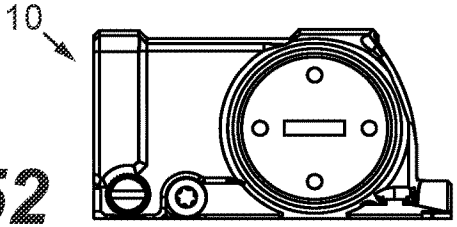
FIG. 52 is a right side elevation view of the assembly of FIG. 49.
Figure 53:
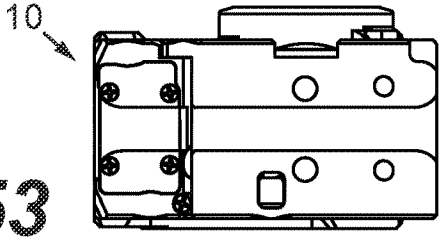
FIG. 53 is a bottom view of the assembly of FIG. 49.
Figure 54:
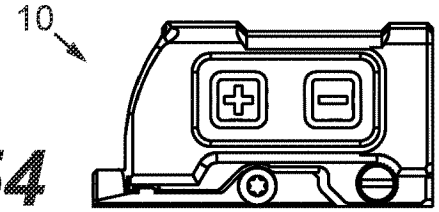
FIG. 54 is a left side elevation view of the assembly of FIG. 49.
Figure 55:
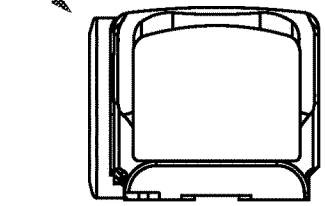
FIG. 55 is a front elevation view of the assembly of FIG. 49.
Figure 56:
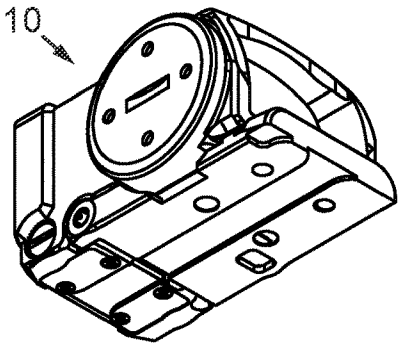
FIG. 56 is a front bottom perspective view of the assembly of FIG. 49.
Figure 57:
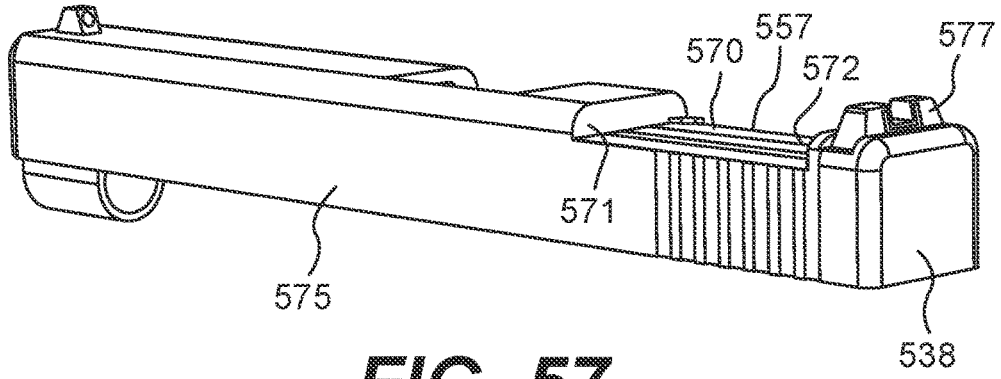
FIG. 57 is a rear perspective view of an embodiment of a semi-automatic pistol slide.

FIGS. 35-37 illustrate a second non-limiting embodiment of a mounting interface 14 of this disclosure operationally configured for use with an embodiment of a Trijicon® RMR® Reflex Sight footprint. FIGS. 38-40 illustrate a third non-limiting embodiment of a mounting interface of this disclosure operationally configured for use with another embodiment of a Trijicon® RMR® Reflex Sight footprint.

Common to each embodiment of mounting interface 14 is an upper surface 192 and a bottom surface 99. Suitably, at least part of the upper surface 192 is operationally configured as an abutment surface for at least part of the enclosed reflex sight 11, e.g., at least part of the bottom surface 179 of the enclosed reflex sight 11. Likewise, at least part of the bottom surface 99 is operationally configured as an abutment surface for at least part of a bottom surface 570 of an upper mounting surface 557 of a firearm 550.

Also common to each embodiment of mounting interface 14 is a fastener hole pattern corresponding to the pattern of fastener holes 187, 188, 189, 190 of the enclosed reflex sight 11. For example, each embodiment of the mounting interface 14 includes two forward vertical threaded fastener holes 194 and 195 corresponding to fastener holes 187 and 188, a left side horizontal fastener hole 196 corresponding to threaded fastener hole 189 and a right side horizontal fastener hole 197 corresponding to threaded fastener hole 190. As shown, fastener hole 196 is disposed through a raised left sidewall 201 of the mounting interface 14 and fastener hole 197 is disposed through a raised right sidewall 202 of the mounting interface 14. In addition to providing substrates for providing fastener holes 196 and 197 the left sidewall 201 and the right sidewall 202 are operationally configured to cradle a corresponding enclosed reflex sight 11 when assembled to assist in maintaining the enclosed reflex sight 11 in a fixed position during operation. Fastener holes 194 and 195 may be referred to herein as front mounts and fastener holes 196 and 197 may be referred to as side mounts for fasteners, e.g., threaded screws.

As further depicted, each embodiment of mounting interface 14 may include one or more through holes corresponding to a mounting standard, e.g., a fastener hole pattern and socket pattern, of a particular firearm mounting footprint for receiving corresponding fasteners 186. For example, the embodiment of FIGS. 32-34 includes two opposing countersunk apertures 205 and 206 disposed at the center or approximate center of the mounting interface 14 corresponding to fastener holes of a firearm. The embodiment of FIGS. 35-37 includes two opposing countersunk apertures 207 and 208 disposed at a rearward part of the mounting interface 14. The embodiment of FIGS. 38-40 includes two opposing raised countersunk apertures 209 and 210 disposed at a rearward part of the mounting interface 14. In one embodiment, the fastener holes of a mounting interface 14 may also be referred to as bolt holes or screw holes.

A housing 12, mounting interface 14 and components comprising the adjustment assembly 100 may be constructed of one or more materials durable for one or more operations and/or as may be required by law or regulation. Suitable materials of construction may include, but are not necessarily limited to those materials resistant to chipping, cracking, excessive bending and reshaping as a result of ozone, weathering, heat, moisture, other outside mechanical and chemical influences, as well as physical impacts. Suitably materials of construction may include one or more metals, plastics, rubbers, woods, filled composite materials, and combinations thereof. Suitable metals include, but are not necessarily limited to stainless steel, hardened steel, mild steel, aluminum, copper, nickel, brass, titanium, and combinations thereof. Suitable plastics include, but are not necessarily limited to glass-filled polymers, durable plastic composite materials, and combinations thereof. One suitable glass-filled polymer includes, but is not necessarily limited to glass-filled nylon. One or more adhesives and/or sealants may be used to secure and/or seal one or more components described herein. In addition, one or more heat treatments and/or one or more coatings may be applied to the housing 12, the mounting interface 14 and one or more other components described herein.

The disclosure will be better understood with reference to the following non-limiting examples, which are illustrative only and not intended to limit the present disclosure to a particular embodiment.

Example 1

In a first non-limiting example, an embodiment of an enclosed reflex sight 11 is provided as shown in FIGS. 41-48. The outer surface of the housing 12 is not limited to the ornamental configuration as shown, but may vary in another embodiment of the housing 12.

Example 2

In a second non-limiting example, an assembly 10 as shown in FIGS. 49-56 is mounted within an upper mounting surface 557 of a pistol slide 575 (see FIGS. 57-60) and the altitude or elevation 580 of a lowermost part 560 of the rear lens 18 is compared to the altitude or elevation 581 of an uppermost surface of a standard height rear sight 577 of the pistol slide 575. As shown in FIG. 61, the altitude or elevation of the lowermost part 560 of the rear lens 18 is lower than the altitude or elevation 581 of the uppermost surface of the standard height rear sight 577.

Figure 4:
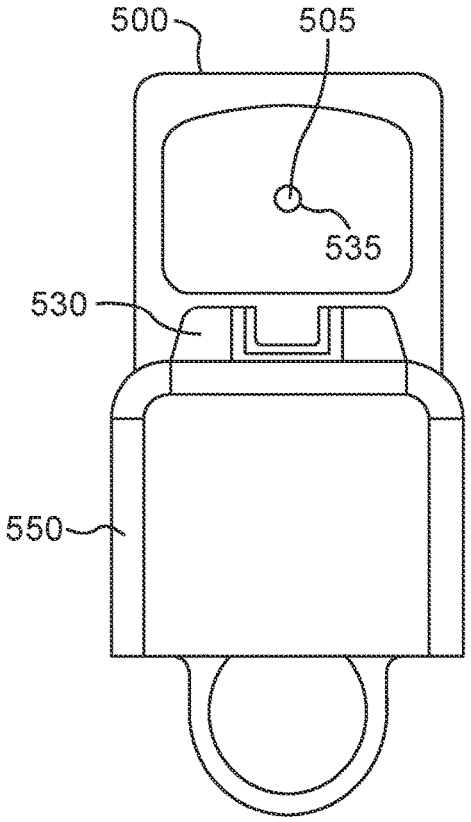
FIG. 4 (Prior Art)
Figure 5:
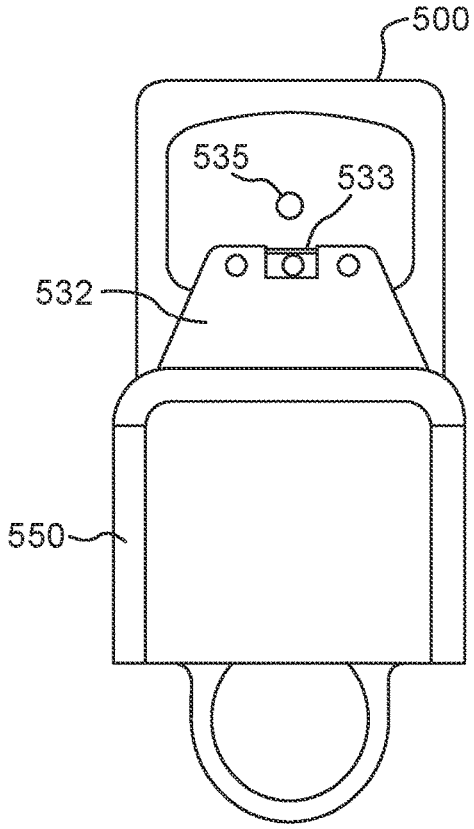
FIG. 5 (Prior Art)
Figure 6:
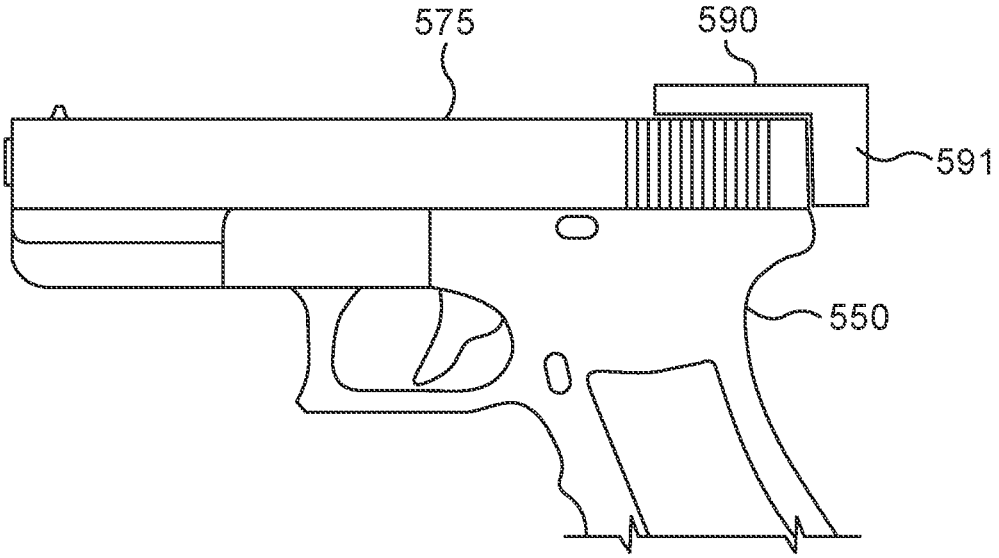
FIG. 6 (Prior Art)
Figure 7:
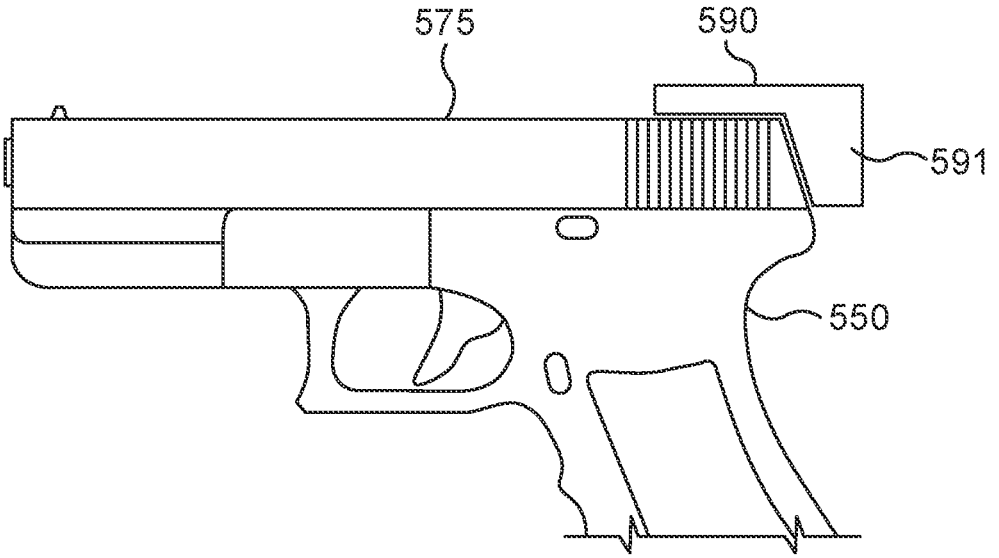
FIG. 7 (Prior Art)

The assembly 10 is removed from the pistol slide 575 and replaced with an enclosed reflex sight 500 as described in reference to FIGS. 3-5. The altitude or elevation 582 of the lowermost part 515 of the rear lens 516 of the enclosed reflex sight 500 is compared to the altitude or elevation 581 of the uppermost surface of the standard height rear sight 577 of the pistol slide 575. As shown in FIG. 61, the altitude or elevation of the lowermost part 515 of the rear lens 516 is higher than the altitude or elevation 581 of the uppermost surface of the standard height rear sight 577.

Example 3

Figure 58:
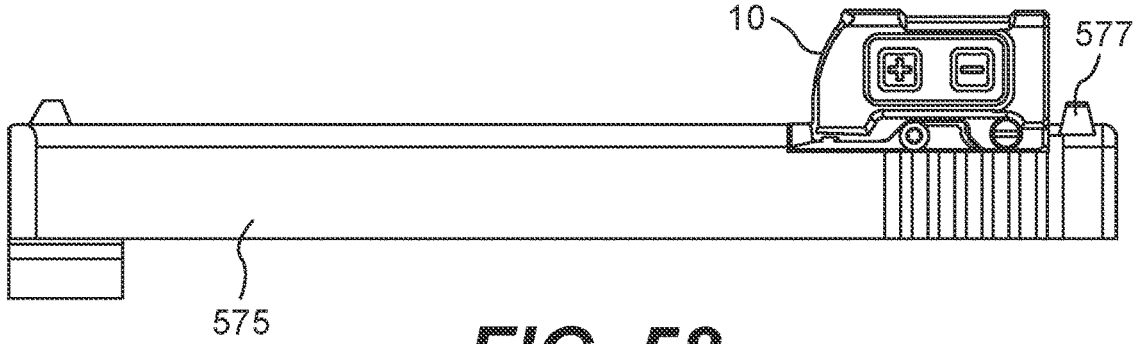
FIG. 58 is a left side view of the assembly of FIG. 8 secured to the semi-automatic pistol slide of FIG. 57.
Figure 59:
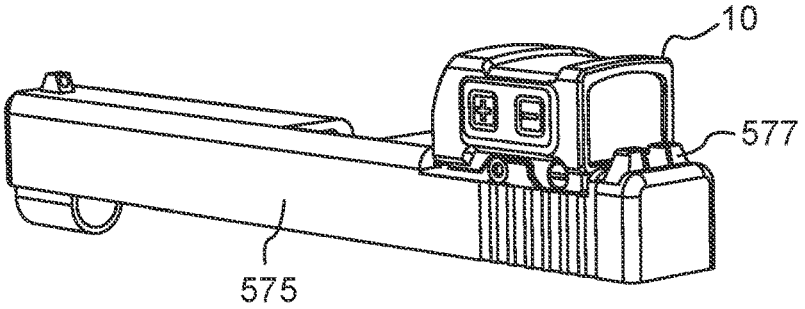
FIG. 59 is a rear left side perspective view of the assembly of FIG. 8 secured to the semi-automatic pistol slide of FIG. 57.
Figure 60:
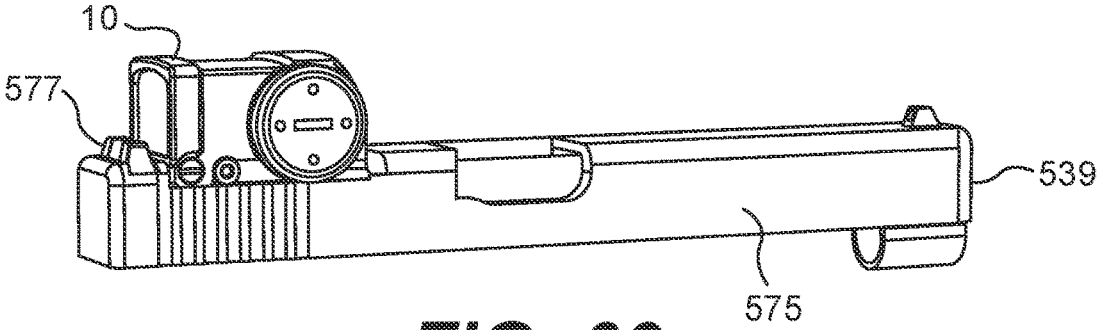
FIG. 60 is a rear right side perspective view of the assembly of FIG. 8 secured to the semi-automatic pistol slide of FIG. 57.
Figure 61:
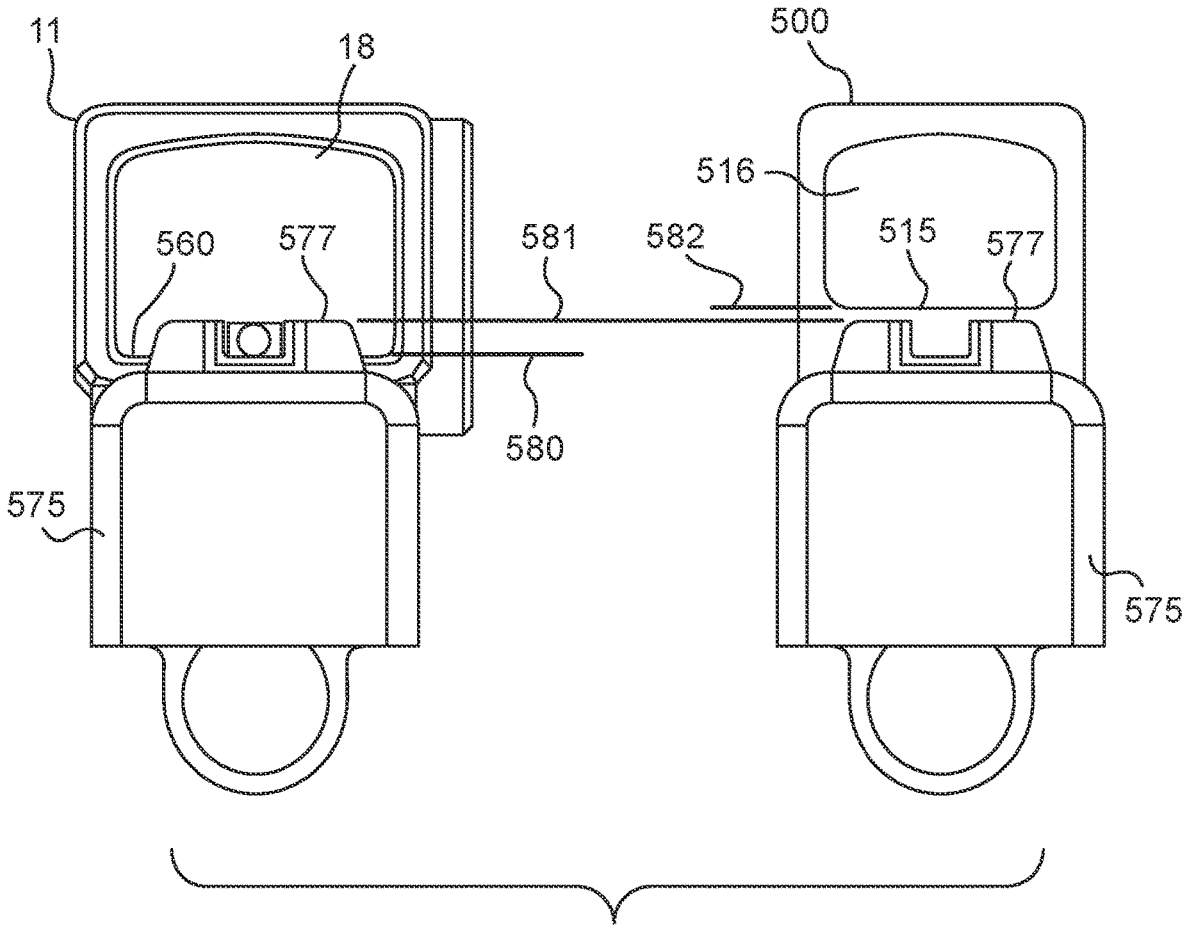
FIG. 61 is a rear view of a side by side comparison including the assembly of FIG. 8 secured to the semi-automatic pistol slide of FIG. 57 on the left and the prior art enclosed reflex sight 500 of FIG. 3 secured to the semi-automatic pistol slide of FIG. 57 on the right.
Figure 62:
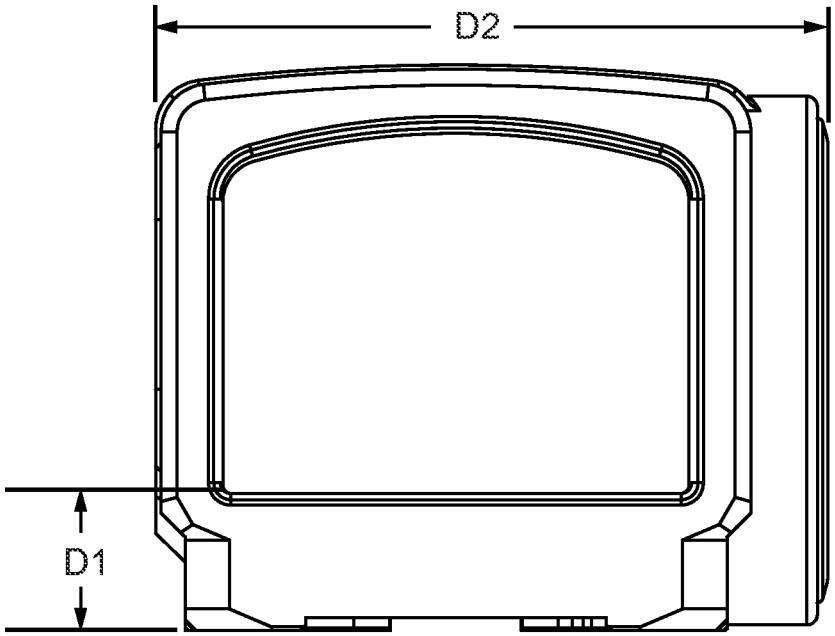
FIG. 62 is a rear elevation view of the enclosed reflex sight of the assembly of FIG. 8.
Figure 63:
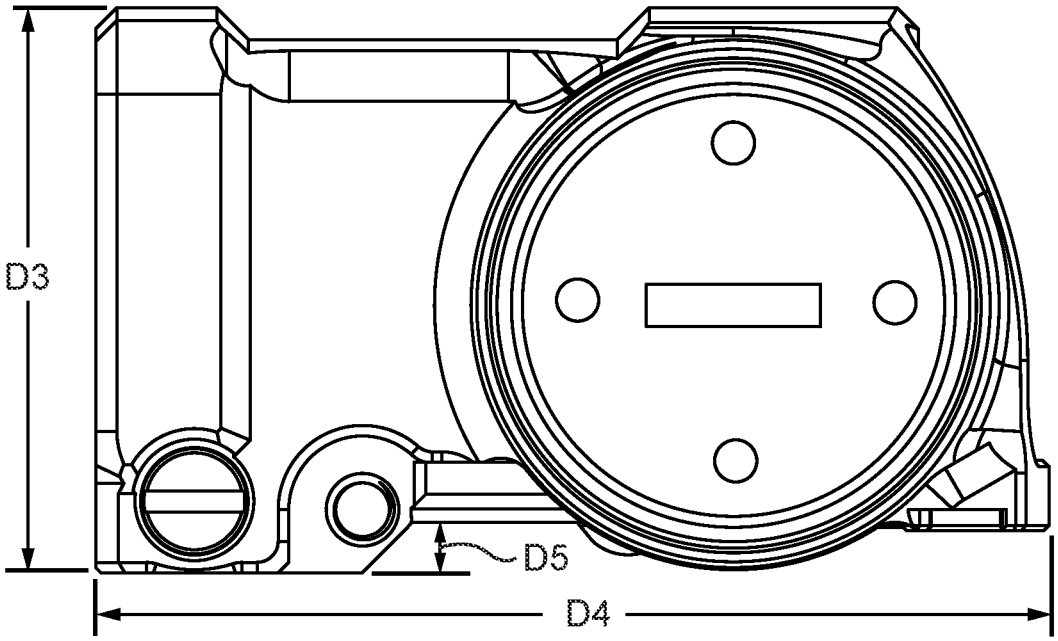
FIG. 63 is a right side elevation view of the enclosed reflex sight of the assembly of FIG. 8.

With reference to FIGS. 62 and 63, in a third non-limiting example an enclosed reflex sight 11 of an assembly 10 as shown in FIGS. 58-60 may comprise the dimensions as shown in Table 1.

TABLE 1

| | |
|---|---|
| D1: | 6.44 mm (0.25 inches); |
| D2: | 31.63 mm (1.25 inches); |
| D3: | 26.42 mm (1.04 inches); |
| D4: | 45.21 mm (1.78 inches); and |
| D5: | 2.15 mm (0.08 inches). |

An assembly 10 and system of the present disclosure may be described according to one or more of the following Embodiments.

Embodiment 1. An assembly, comprising:

an enclosed reflex sight; and a mounting interface;

wherein the enclosed reflex sight includes a rearward bottom portion that houses an adjustment assembly of the enclosed reflex sight and wherein the rearward bottom portion defines a lowermost surface of the enclosed reflex sight;

wherein the enclosed reflex sight includes an upper bottom surface forward of the rearward bottom portion of the enclosed reflex sight, the upper bottom surface comprising an abutment surface for the mounting interface; and wherein when the assembly is secured to an upper mounting surface of a firearm then the lowermost surface of the rearward bottom portion of the enclosed reflex sight is closer to the upper mounting surface of the firearm than the upper bottom surface of the enclosed reflex sight.

Embodiment 2. The assembly of Embodiment 1, wherein the assembly includes a first maximum height and wherein the enclosed reflex sight includes a second maximum height the same or substantially similar as the first maximum height.

Embodiment 3. The assembly of Embodiment 1, wherein the assembly includes a maximum height and wherein the height of the enclosed reflex sight from an uppermost surface of the enclosed reflex sight to the lowermost surface of the enclosed reflex sight is the same or substantially similar as the maximum height of the assembly.

Embodiment 4. The assembly of Embodiment 1, wherein a first distance between an optical center of a clear aperture of the enclosed reflex sight and the lowermost surface of the enclosed reflex sight is the same or substantially similar as a second distance between the optical center of the clear aperture and a bottommost surface of the mounting interface.

Embodiment 5. An assembly, comprising:

an enclosed reflex sight; and a mounting interface;

wherein when the assembly is secured to an upper mounting surface of a firearm then the lowermost surface of the enclosed reflex sight is located at a position closer to the upper mounting surface of the firearm than at least part of the mounting interface and the assembly is located forward of a rear end surface of the firearm.

Embodiment 6. The assembly of Embodiment 5, wherein the assembly includes a first maximum height and the enclosed reflex sight includes a second maximum height the same or substantially similar as the first maximum height.

Embodiment 7. The assembly of Embodiment 5, wherein a distance between an optical center of a clear aperture of the enclosed reflex sight and the lowermost surface of the enclosed reflex sight is the same or substantially similar as a distance between the optical center of the clear aperture and a bottommost part of the mounting interface.

Embodiment 8. The assembly of Embodiment 5, wherein the enclosed reflex sight comprises a first length and the mounting interface includes a second length less than the first length.

Embodiment 9. The assembly of Embodiment 5, wherein the enclosed reflex sight includes a windage adjustment mechanism and an elevation adjustment mechanism that are located behind the mounting interface.

Embodiment 10. An assembly, comprising:

an enclosed reflex sight; and a plurality of mounting interfaces;

wherein each of the plurality of mounting interfaces is configured to secure the assembly to one or more of a plurality of firearms comprising a plurality of upper mounting surface footprints;

wherein when the assembly is secured to an upper mounting surface of a first firearm of the plurality of firearms then the assembly is located on top of the first firearm forward of a rear end surface of the first firearm; and wherein the assembly includes a first maximum height and the enclosed reflex sight includes a second maximum height the same or substantially similar as the first maximum height.

Embodiment 11. The assembly of Embodiment 10, wherein when the assembly is secured to the upper mounting surface of the first firearm then the mounting interface of the assembly is located forward of at least part of the enclosed reflex sight.

Embodiment 12. The assembly of Embodiment 10, wherein the enclosed reflex sight includes a rearward bottom portion that houses an adjustment assembly of the enclosed reflex sight and wherein the rearward bottom portion defines a lowermost surface of the enclosed reflex sight.

Embodiment 13. An assembly, comprising:

an enclosed reflex sight; and a plurality of mounting interfaces, each of the plurality of mounting interfaces being configured to secure the enclosed reflex sight to one or more firearms of a plurality of firearms comprising a plurality of upper mounting surface footprints;

wherein when the assembly is secured to an upper mounting surface of a first firearm of the plurality of firearms then the assembly is located on top of the first firearm forward of a rear end surface of the first firearm; and wherein the assembly includes a first maximum height and the enclosed reflex sight includes a second maximum height the same or substantially similar as the first maximum height.

Embodiment 14. An assembly, comprising:

an enclosed reflex sight; and a mounting interface for securing the enclosed reflex sight to an upper mounting surface of a firearm;

wherein the enclosed reflex sight includes a first bottom surface at a first altitude or elevation and a second bottom surface at a second altitude or elevation lower than the first altitude or elevation; and wherein when the assembly of the enclosed reflex sight and the mounting interface is in a secured position with an upper mounting surface of a firearm then the first bottom surface and the second bottom surface of the enclosed reflex sight are located forward of a rear end surface of the firearm.

Embodiment 15. The assembly of Embodiment 14, wherein the mounting interface includes an upper surface operationally configured as an abutment surface for the first bottom surface of the enclosed reflex sight.

Embodiment 16. An assembly, comprising:

an enclosed reflex sight; and a mounting interface for securing the enclosed reflex sight to an upper mounting surface of a firearm;

wherein the enclosed reflex sight includes a first bottom surface at a first altitude or elevation and a second bottom surface at a second altitude or elevation lower than the first altitude or elevation; and wherein when the assembly is secured to an upper mounting surface of a firearm comprising a protruding rear sight then the first bottom surface and the second bottom surface of the enclosed reflex sight are located forward of protruding rear sight.

Embodiment 17. The assembly of Embodiment 16, wherein the mounting interface includes an upper surface operationally configured as an abutment surface for the first bottom surface of the enclosed reflex sight.

Embodiment 18. The assembly of Embodiment 16, wherein the mounting interface includes a bottom surface operationally configured as an abutment surface for an upper mounting surface of the firearm and wherein when the assembly is secured to the upper mounting surface of the firearm then the second bottom surface of the enclosed reflex sight is in planar alignment or substantially planar alignment with the bottom surface of the mounting interface.

Embodiment 19. An assembly, comprising:

an enclosed reflex sight; and a mounting interface;

wherein the enclosed reflex sight includes a lowermost surface;

wherein when the assembly is secured to an upper mounting surface of a firearm then the entire assembly is located on top of the firearm; and wherein when the firearm is oriented in a firing position then the lowermost surface of the enclosed reflex sight is located at an altitude or elevation lower than at least part of the mounting interface.

Embodiment 20. The assembly of Embodiment 19, wherein the assembly includes a maximum height and the enclosed reflex sight includes a maximum height the same or substantially similar as the maximum height of the assembly.

Embodiment 21. The assembly of Embodiment 19, wherein the enclosed reflex sight includes a clear aperture with an optical center and wherein a distance between the optical center of the clear aperture of the enclosed reflex sight and the lowermost surface of the enclosed reflex sight is the same or substantially similar as a distance between the optical center of the clear aperture and a bottommost part of the mounting interface.

Embodiment 22. An assembly, comprising:

an enclosed reflex sight; and a mounting interface;

wherein the enclosed reflex sight includes a lowermost surface;

wherein when the assembly is secured to an upper mounting surface of a firearm and when the firearm is oriented in a firing position then the lowermost surface of the enclosed reflex sight is located at an altitude or elevation lower than at least part of the mounting interface; and wherein when the assembly is secured to the upper mounting surface of a firearm comprising a protruding rear sight then the entire assembly is located forward of the protruding rear sight of the firearm.

Embodiment 23. An assembly, comprising:

an enclosed reflex sight; and a mounting interface;

wherein when the assembly is secured to an upper mounting surface of a firearm then the lowermost surface of the enclosed reflex sight is located at a distance from the upper mounting surface of the firearm less than a distance of at least part of the mounting interface from the upper mounting surface and the assembly is located forward of a rear end surface of the firearm.

Embodiment 24. An assembly, comprising:

an enclosed reflex sight; and a mounting interface;

wherein the enclosed reflex sight includes a lowermost surface; and wherein when the assembly is secured to an upper mounting surface of a firearm oriented in a firing position then the lowermost surface of the enclosed reflex sight is located at an altitude lower than at least part of the mounting interface and the assembly is located forward of a rear end surface of the firearm.

Embodiment 25. A system, comprising:

at least one firearm; and an assembly comprising:

an enclosed reflex sight; and at least one mounting interface;

wherein the enclosed reflex sight includes a rearward bottom portion that houses an adjustment assembly of the enclosed reflex sight and wherein the rearward bottom portion defines a lowermost surface of the enclosed reflex sight;

wherein the enclosed reflex sight includes an upper bottom surface forward of the rearward bottom portion of the enclosed reflex sight, the upper bottom surface comprising an abutment surface for the at least one mounting interface; and wherein when the assembly is secured to an upper mounting surface of a firearm then the lowermost surface of the rearward bottom portion of the enclosed reflex sight is closer to the upper mounting surface of the firearm than the upper bottom surface of the enclosed reflex sight.

Embodiment 26. The system of Embodiment 25, wherein the assembly includes a first maximum height and wherein the enclosed reflex sight includes a second maximum height the same or substantially similar as the first maximum height.

Embodiment 27. The system of Embodiment 25, wherein a first distance between an optical center of a clear aperture of the enclosed reflex sight and the bottom surface of the rearward bottom portion of the enclosed reflex sight is the same or substantially similar as a second distance between the optical center of the clear aperture and a bottommost surface of the at least one mounting interface.

Embodiment 28. The system of Embodiment 25, wherein the system comprises two or more mounting interfaces.

Embodiment 29. A system comprising:

at least one firearm comprising an upper mounting surface; and an assembly securable to the upper mounting surface comprising:

an enclosed reflex sight; and at least one firearm mounting interface;

wherein the assembly includes a maximum height and wherein the enclosed reflex sight includes a maximum height the same or substantially similar as the maximum height of the assembly; and wherein the assembly is located forward of a rear end surface of the firearm.

Embodiment 30. The system of Embodiment 29, the system comprising two or more firearm mounting interfaces.

Embodiment 31. The system of Embodiment 30, wherein each firearm mounting interface of the two or more firearm mounting interfaces is configured for use with a different upper mounting surface footprint.

Embodiment 32. The system of Embodiment 29, wherein the assembly includes a first maximum height and the enclosed reflex sight includes a second maximum height the same or substantially similar as the first maximum height.

Embodiment 33. The system of Embodiment 29, wherein a first distance between an optical center of a clear aperture of the enclosed reflex sight and a lowermost surface of the enclosed reflex sight is the same or substantially similar as a second distance between the optical center of the clear aperture and a bottommost part of the at least one firearm mounting interface.

Embodiment 34. The system of Embodiment 29, wherein the enclosed reflex sight comprises a first length and the mounting interface includes a second length less than the first length.

Embodiment 35. The system of Embodiment 29, wherein the enclosed reflex sight includes a windage adjustment mechanism and an elevation adjustment mechanism that are located behind the at least one firearm mounting interface.

Embodiment 36. The system of Embodiment 29, wherein when the assembly is secured to the at least one firearm then the at least one firearm mounting interface is located forward of at least part of the enclosed reflex sight.

Embodiment 37. A system, comprising:

a plurality of firearms providing at least two different upper mounting surfaces; an enclosed reflex sight; and a plurality of mounting interfaces, each mounting interface of the plurality of mounting interfaces being configured to secure the enclosed reflex sight to at least one upper mounting surface of the at least two different upper mounting surfaces;

wherein when the enclosed reflex sight is secured to the at least one upper mounting surface of a first firearm of the plurality of firearms via a first mounting interface of the plurality of mounting interfaces then the enclosed reflex sight is located on top of the first firearm forward of a rear surface of the first firearm wherein a lowermost surface of the enclosed reflex sight is located closer to the at least one upper mounting surface than at least part of the first mounting interface.

Embodiment 38. The system of Embodiment 35, wherein the enclosed reflex sight includes a rearward bottom portion that houses an adjustment assembly of the enclosed reflex sight, the rearward bottom portion comprising the lowermost surface of the enclosed reflex sight.

Embodiment 39. A system, comprising:

at least one firearm; and an assembly comprising:

an enclosed reflex sight; and at least one mounting interface;

wherein the enclosed reflex sight comprises windage and elevation adjustment mechanisms located in a rearward bottom portion of the enclosed reflex sight;

wherein when the assembly is mounted to the at least one firearm oriented in a firing position then a bottom surface of the rearward bottom portion of the enclosed reflex sight is located at an altitude lower than at least part of the mounting interface; and wherein the rearward bottom portion of the enclosed reflex sight is located forward of a rear end surface of the firearm.

Embodiment 40. A system, comprising:

a plurality of firearms providing at least two different upper mounting surfaces;

one or more enclosed reflex sights; and a plurality of mounting interfaces, each mounting interface of the plurality of mounting interfaces being operationally configured to secure at least one of the one or more enclosed reflex sights to at least one upper mounting surface of one or more firearms of the plurality of firearms;

wherein when a first enclosed reflex sight of the one or more enclosed reflex sights is secured to a first firearm of the plurality of firearms via a first mounting interface of the plurality of mounting interfaces and when the first firearm is oriented in a firing position then the enclosed reflex sight includes a lowermost surface that is located at an altitude or elevation lower than at least part of the first mounting interface; and the first enclosed reflex sight is located on top of the first firearm forward of a rear end surface of the first firearm.

Embodiment 41. A method of aiming a firearm at a target, comprising presenting at the target the firearm comprising an enclosed reflex sight and firearm mounting interface assembly wherein the maximum height of the enclosed reflex sight is the same or substantially similar as the maximum height of the assembly of the enclosed reflex sight and the firearm mounting interface.

Although the present disclosure is described above in terms of various exemplary embodiments and implementations, it should be understood that the various features and functionality described in one or more of the individual embodiments are not limited in their applicability to the particular embodiment with which they are described, but instead might be applied, alone or in various combinations, to one or more other embodiments whether or not such embodiments are described and whether or not such features are presented as being a part of a described embodiment. Thus, the breadth and scope of the claimed invention should not be limited by any of the above-described embodiments.

Terms and phrases used in this disclosure, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," "one or a plurality" or the like.

Persons of ordinary skill in the art will recognize that many modifications may be made to the present disclosure without departing from the spirit and scope of the disclosure. The embodiment(s) described herein are meant to be illustrative only and should not be taken as limiting the invention, which is defined in the claims.

I claim:

1. An assembly, comprising:

an enclosed reflex sight; and a mounting interface;

wherein when the assembly is secured to an upper mounting surface of a firearm then the lowermost surface of the enclosed reflex sight is located at a position closer to the upper mounting surface of the firearm than at least part of the mounting interface and the assembly is located forward of a rear end surface of the firearm; and wherein the enclosed reflex sight includes a windage adjustment mechanism and an elevation adjustment mechanism that are located behind the mounting interface.

2. The assembly of claim 1, wherein the assembly includes a first maximum height and the enclosed reflex sight includes a second maximum height the same or substantially similar as the first maximum height.

3. The assembly of claim 1, wherein a distance between an optical center of a clear aperture of the enclosed reflex sight and the lowermost surface of the enclosed reflex sight is the same or substantially similar as a distance between the optical center of the clear aperture and a bottommost part of the mounting interface.

4. The assembly of claim 1, wherein the enclosed reflex sight comprises a first length and the mounting interface includes a second length less than the first length.

* * * * *